US012213542B2

(12) United States Patent
Temeng

(10) Patent No.: US 12,213,542 B2
(45) Date of Patent: Feb. 4, 2025

(54) SYSTEM FOR PUMP-CONDITIONING GARMENT WORN ON TORSO OR THE LIKE

(71) Applicant: Kwaku Temeng, Wilmington, DE (US)

(72) Inventor: Kwaku Temeng, Wilmington, DE (US)

( * ) Notice: Subject to any disclaimer, the term of this patent is extended or adjusted under 35 U.S.C. 154(b) by 0 days.

(21) Appl. No.: 18/238,596

(22) Filed: Aug. 28, 2023

(65) Prior Publication Data

US 2023/0404183 A1 Dec. 21, 2023

Related U.S. Application Data

(63) Continuation-in-part of application No. 17/868,891, filed on Jul. 20, 2022, now Pat. No. 12,029,263, which is a continuation-in-part of application No. 16/502,854, filed on Jul. 3, 2019, now Pat. No. 11,432,597.

(51) Int. Cl.

| | |
|---|---|
| ***A41D 13/002*** | (2006.01) |
| ***A41D 27/28*** | (2006.01) |
| ***A41D 31/14*** | (2019.01) |

(52) U.S. Cl.

CPC ..... *A41D 13/0025* (2013.01); *A41D 27/28* (2013.01); *A41D 31/145* (2019.02)

(58) Field of Classification Search

CPC ..... A41D 13/0158; A41D 13/0053; A41D 13/005; A61F 2007/0234; A61F 2007/0233

See application file for complete search history.

(56) References Cited

U.S. PATENT DOCUMENTS 4,194,247 A * 3/1980 Melander ..... A41D 13/0025 2/457
5,201,365 A * 4/1993 Siegel ..... A41D 13/0056 607/104

(Continued)

FOREIGN PATENT DOCUMENTS

CN 215649363 1/2022
CN 215649363 U * 1/2022

(Continued)

OTHER PUBLICATIONS

Springs Creative Website, Spacer Fabric, https://www.springscreative.com/products/spacerfabric/ , downloaded Jun. 26, 2019.

(Continued)

*Primary Examiner* — Jillian K Pierorazio
(74) *Attorney, Agent, or Firm* — Steven H. Meyer, Esq.

(57) ABSTRACT

A system pump-conditions a garment worn about a torso of an individual. A circulation array within the garment and a pump array circulate a fluid within an interior space between the garment and the torso. The pump array exerts a negative pressure on the circulation array to circulate the fluid generally from a head opening at a top portion of the garment, into the interior space, then through the circulation array, then out of the garment. The pump array exhausts the circulating fluid down and away from the torso. The moving circulating fluid draws heat and humidity from within the garment and directs same away from such individual to cool and comfort same. The moving circulating fluid also draws a cooling and comforting breeze about the head of the individual.

20 Claims, 11 Drawing Sheets

(56) References Cited

U.S. PATENT DOCUMENTS 5,970,519 A * 10/1999 Weber ..... A41D 13/0025 2/81
6,085,353 A 7/2000 van der Sleesen
6,105,382 A * 8/2000 Reason ..... A41D 13/005 165/46
6,109,338 A * 8/2000 Butzer ..... A41D 13/005 607/104
6,260,201 B1 * 7/2001 Rankin ..... A41D 13/0053 2/81
6,339,845 B1 1/2002 Burns
6,349,412 B1 * 2/2002 Dean ..... A41D 13/0053 2/102
6,681,399 B1 1/2004 Kerr
7,089,995 B2 * 8/2006 Koscheyev ..... A61F 7/02 607/104
7,412,728 B2 8/2008 Alesina
7,823,625 B2 * 11/2010 Gammons ..... F16L 37/0841 165/46
8,281,609 B1 * 10/2012 Rothschild ..... A41D 13/0053 62/259.3
8,359,871 B2 * 1/2013 Woods ..... H10N 10/13 62/3.2
8,397,518 B1 * 3/2013 Vistakula ..... A61F 7/02 62/3.5
9,309,689 B2 4/2016 Fier
2002/0029410 A1 * 3/2002 Szymocha ..... A41D 13/0051 2/458
2003/0029186 A1 * 2/2003 Schegerin ..... F25D 3/14 62/299
2003/0045918 A1 * 3/2003 Turner ..... A61F 7/02 607/108
2005/0139351 A1 * 6/2005 Chambers ..... F28F 21/00 62/259.3
2005/0197684 A1 9/2005 Koch
2006/0026743 A1 2/2006 Farnworth
2007/0000008 A1 * 1/2007 Sawicki ..... A41D 13/0025 2/69
2007/0084496 A1 4/2007 Edey
2007/0095088 A1 5/2007 Drobot Isherwood
2008/0141428 A1 6/2008 Kapah
2009/0077710 A1 3/2009 Bay
2009/0199571 A1 * 8/2009 Creech ..... A61F 7/02 62/515
2009/0260711 A1 * 10/2009 Alder ..... B63C 9/18 2/458
2009/0308082 A1 * 12/2009 Monk ..... A41D 13/005 62/3.5
2010/0011491 A1 1/2010 Goldman
2010/0084125 A1 * 4/2010 Goldstein ..... F17C 11/00 62/3.5
2010/0125928 A1 * 5/2010 Smith ..... B63C 11/08 165/61
2010/0223943 A1 * 9/2010 Loukaides ..... A41D 13/0053 62/259.3
2010/0281883 A1 * 11/2010 Romano ..... A41D 13/005 62/3.5
2012/0036623 A1 * 2/2012 Minogue ..... A41D 13/0158 2/463
2013/0025315 A1 * 1/2013 Freeman ..... F28F 13/003 165/46
2013/0178146 A1 7/2013 Stockett
2014/0069410 A1 * 3/2014 Adafin ..... A41D 13/0051 126/204
2014/0130225 A1 5/2014 Balzano
2014/0201891 A1 * 7/2014 Turner ..... A41D 13/015 2/455
2014/0222121 A1 * 8/2014 Spence ..... A61F 7/02 607/104
2015/0025485 A1 1/2015 Luckemeyer
2015/0231419 A1 * 8/2015 Allan ..... A62B 17/005 128/201.29
2015/0374537 A1 * 12/2015 Susi ..... A61F 7/007 607/104
2017/0027053 A1 * 1/2017 Moczygemba ..... H05K 1/0203
2017/0095395 A1 4/2017 Wennen
2017/0099899 A1 4/2017 Pezzimenti
2018/0317572 A1 * 11/2018 Guttman ..... A41D 27/28
2022/0029410 A1 1/2022 Fukuhara

FOREIGN PATENT DOCUMENTS

WO 2017048198 3/2017
WO WO-2017048198 A1 * 3/2017 ..... A41D 13/0005

OTHER PUBLICATIONS

TTP Ventus Website, Disc Pump Products, https://www.ttpventus.com/products , downloaded Jun. 26, 2019.

* cited by examiner

SYSTEM FOR PUMP-CONDITIONING GARMENT WORN ON TORSO OR THE LIKE

CROSS-REFERENCE TO RELATED APPLICATION

The present application is a continuation-in-part of U.S. patent application Ser. No. 17/868,891, filed on Jul. 20, 2022 and entitled "Pump-Conditioned Garment and Apparatus Therefor", and published as U.S. Pat. App. Pub. No. US 2022/0346470, hereby incorporated by reference in its entirety, which in turn is a continuation-in-part of U.S. patent application Ser. No. 16/502,854, filed on Jul. 3, 2019 and entitled "Pump-Conditioned Garment and Apparatus Therefor", and published as U.S. Pat. App. Pub. No. US 2021/0000195, hereby incorporated by reference in its entirety.

FIELD

The present disclosure relates to a garment with an apparatus included therewith that pumps or otherwise circulates a fluid within the garment. More particularly, the present disclosure relates to such a garment and apparatus with an air pump for circulating venting air within the garment so as to provide a wearer of the garment with a more comfortable environment.

BACKGROUND

To protect an individual against wind, rain, and similar adverse environmental conditions, it is believed to be generally known that an external garment such as a running jacket, a ski jacket, a parka, and the like may be designed with a fabric shell or the like that has low air permeability so as to prevent external air from being admitted, perhaps in combination with an insulating layer. Thus, the fabric shell and the insulating layer if present act to keep adverse environmental conditions such as rain, snow, and cold air away from direct contact with the individual, and also to keep favorable environmental conditions such as warm dry air in closer contact with the individual.

Notably, when such individual wears such external garment during exercising, for example, the fabric shell and insulating layer if present provide good protection during the initial stages of exercising, when the body of the individual is relatively cool and dry. However, as the individual continues to exercise and the body thereof becomes relatively warm and wet, the fabric shell and insulating layer if present can tend to trap heat and moisture within the garment, to the point where the individual can become uncomfortably warm and humid within such garment. As should be appreciated, the fabric shell and insulating layer if present limit the venting of internal moisture and heat generated from such exercise so that the interior of the garment becomes uncomfortably humid and wet and creates a relatively high level of discomfort.

To alleviate such discomfort as caused by air impermeability and/or heat insulation in a garment, it is among other things known that air vents, water vapor vents, and/or the like may be incorporated into the garment so as to provide an exchange of heat and/or moisture between the internal environment of the garment and the external environment. Such vents may generally be characterized by control mechanisms such as zippers or sliders that open to allow for the exchange of air between the interior and exterior of the garment at the discretion of the individual wearing same, mesh panels in the fabric shell that allow for a continuous exchange of air, or the like.

However, such control mechanisms, mesh panels, and the like have been found to have drawbacks and limitations. Firstly, the individual wearing the garment typically may have to stop the exercising activity to make adjustments as necessary, for example to open or close zippers. Secondly, such adjustments may be physically challenging, such as for example if the zippers are on a back side of the garment. In such an instance, it may be that the garment must be removed for gaining access to such zippers. Thirdly, opening and/or opened vents during rain and snow events can lead to interior penetration of water within the garment, which can be uncomfortable and perhaps can lead to hypothermia. Fourthly, even when vents are opened, the full benefits of venting may be unachievable due to varying obstructions. Here, it may be that a vent is blocked internally by an insulating layer, or externally by an external object such as a covering garment, a backpack, or the like. With regard to a backpack in particular, it is known that covering the back of the individual therewith can allow an excessive amount of warmth and perspiration to build up thereat, regardless of whatever venting may be provided in the garment in such region.

In general, garment venting suffers from the difficulty of adjusting a vent to match a current level of exertion and also any change in ambient conditions. That is, current garment vents do not allow for increased venting during a time of exertion and also for decreased venting at a time of rest, without manual adjustment, and also do not allow for increased venting when the external ambient temperature rises and also for decreased venting when such external ambient temperature falls, also without manual adjustment. Likewise, current garment vents do not allow for changes in external humidity, in internal humidity, in daylight, in wind speed, etc. Instead, an individual wearing a vented garment must focus on such issues to the point of distraction, and oftentimes fails to do so with the result being that the individual becomes over-heated, over-perspired, and/or overly chilled, among other things, with resulting discomfort.

Convective air flow systems have been proposed which employ one or more fans to induce air flow into and out of a garment. However, the fans are blade-based and can become compromised if the blades encounter interference. Also, the fans become all but useless if covered by a covering garment, a backpack, etc., and generally the fans are conspicuous and yet not aesthetically pleasing.

Accordingly, a need exists for a pump-conditioned garment and apparatus therefor which can be employed to actively and adaptably vent a garment. Specifically, a need exists for such a garment and apparatus that pumps or otherwise circulates a fluid within the garment in an effort to establish an environment within the garment that is more comfortable to an individual wearing the garment. More particularly, a need exists for such a garment and apparatus with an air pump for circulating venting air within the garment in response to sensed changes to the environment within the garment and also changes to the external environment.

SUMMARY

The aforementioned needs are satisfied by a system pump-conditioning a garment worn about a torso of an individual. In the system, a circulation array circulates a fluid within an interior space between the garment and the torso of the individual in an effort to condition the individual, and one or more pumps is organized into one or more pump arrays. Each pump array includes the pumps thereof in a unitary package and also includes an inlet and an outlet. Each pump array operates as a unit to provide motive force to move the circulating fluid through the circulation array. Each pump array exerts a negative pressure on the circulation array within the garment to draw circulating fluid therefrom. The circulation array is arranged with respect to the garment to draw circulating fluid generally from a head opening at a top portion of the garment.

The circulating fluid in response to the negative pressure of each pump array generally moves into the interior space of the garment at the head opening thereof, then through the circulation array, then out of the garment toward the inlet of each pump array. Each pump array receives the circulating fluid at the inlet thereof and exhausts same at the outlet thereof down and away from the torso of the individual. The moving circulating fluid draws heat and humidity from about the torso of the individual within the garment, and directs such heat and humidity away from such individual to cool and comfort same. The moving circulating fluid also draws a cooling and comforting breeze about a head of the individual.

BRIEF DESCRIPTION OF THE DRAWINGS

The foregoing summary as well as the following detailed description of various embodiments of the present innovation will be better understood when read in conjunction with the appended drawings. For the purpose of illustrating the various embodiments of the innovation, there are shown in the drawings embodiments that may be preferred. As should be understood, however, the innovation is not limited to the precise arrangements and instrumentalities shown. In the drawings.

DETAILED DESCRIPTION OF PREFERRED EMBODIMENTS

Figure 1:
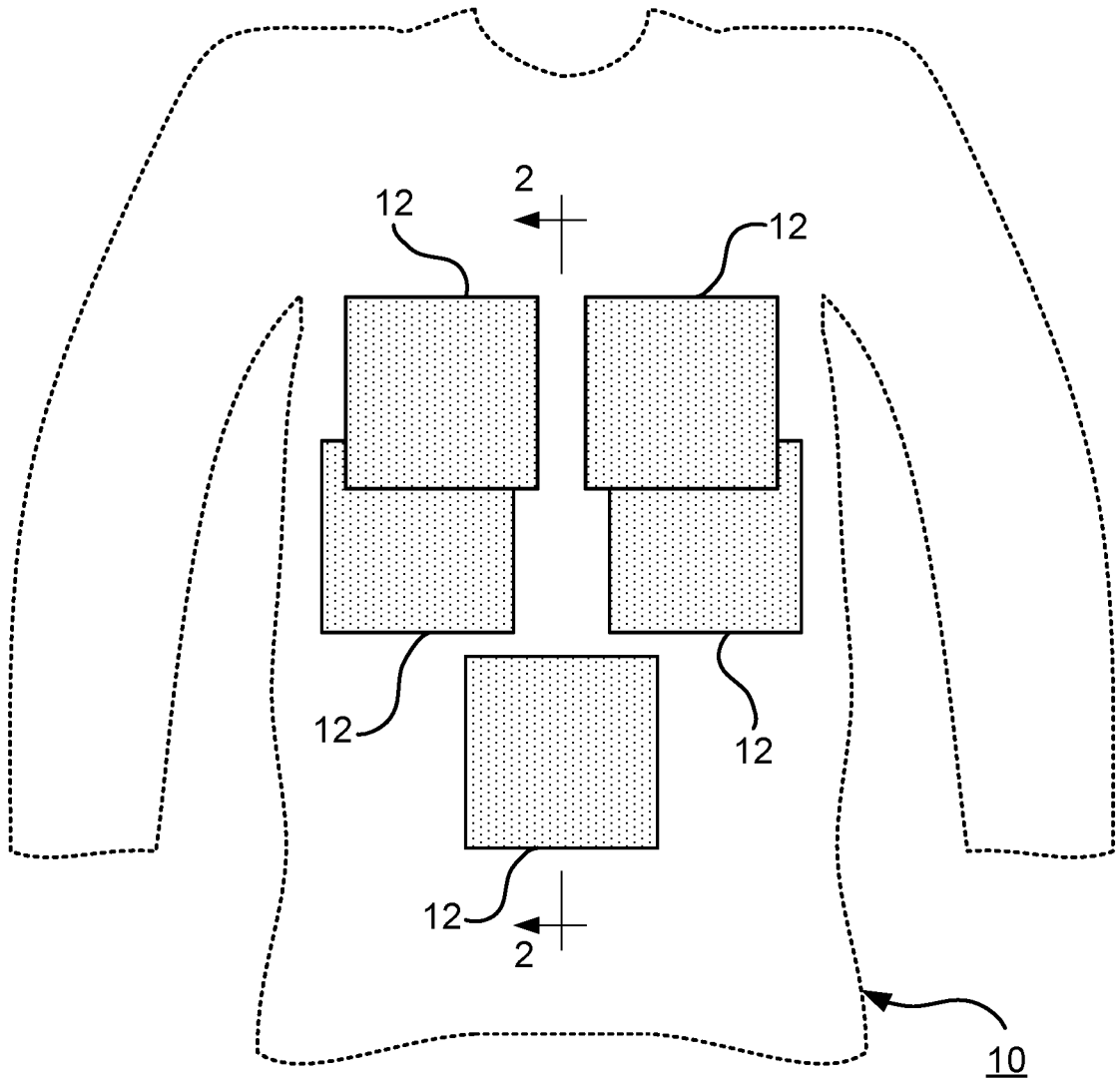
FIG. 1 is a front elevational and somewhat schematic depiction of a garment having one or more vent panels therein for circulating a fluid within the garment in accordance with various embodiments of the present innovation.

Certain terminology may be used in the following description for convenience only and is not limiting. The words "lower" and "upper" and "top" and "bottom" designate directions in the drawings to which reference is made. The terminology includes the words above specifically mentioned, derivatives thereof and words of similar import.

Where a term is provided in the singular, the inventors also contemplate aspects of the invention described by the plural of that term. As used in this specification and in the appended claims, the singular forms "a", "an" and "the" include plural references unless the context clearly dictates otherwise, e.g., "a tip" includes a plurality of tips. Thus, for example, a reference to "a method" includes one or more methods, and/or steps of the type described herein and/or which will become apparent to those persons skilled in the art upon reading this disclosure.

Unless defined otherwise, all technical and scientific terms used herein have the same meaning as commonly understood by one of ordinary skill in the art to which this invention belongs. Although any methods and materials similar or equivalent to those described herein can be used in the practice or testing of the present innovation, the preferred methods, constructs and materials are now described.

Figure 2:
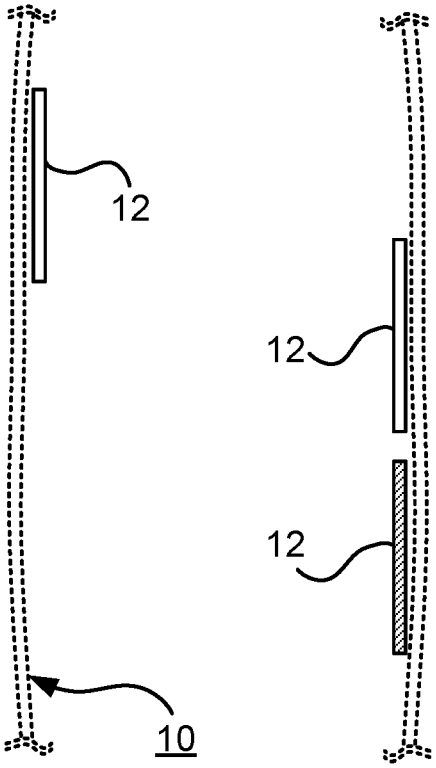
FIG. 2 is a cross-sectional view of the garment of FIG. 1 taken along the line 2-2 thereof, and in particular shows a vent panel on the left side of the front of the garment as seen in FIG. 1, a vent panel on the left side of the back of the garment as seen in FIG. 1, and a portion of a vent panel in the lower center of the back of the garment as seen in FIG. 1, in accordance with various embodiments of the present innovation.

Turning now to FIGS. 1 and 2, a representation of a pump-conditioned garment 10 is shown to include one or more fluid-circulating vent panels 12 in various embodiments of the present innovation. As shown in the representation of FIGS. 1 and 2, the garment 10 includes a pair of vent panels 12 on the left and right side of the interior of the front of the garment 10, another pair of vent panels 12 on the left and right side of the interior of the back of the garment 10, where the back pair are in elevation slightly lower than the front pair, and a single vent panel 12 in the lower center of the interior of the back of the garment, where the center panel 12 is in elevation below the rear pair.

As will be set forth in more detail below, each fluid-circulating vent panel 12 is intended to circulate a fluid such as air or a liquid adjacent the garment 10 in an effort to cool such adjacency and/or remove moisture, among other things. Notably, the garment 10 may be most any garment without departing from the spirit and scope of the present innovation. As shown in FIGS. 1 and 2, the garment 10 is generally shaped to be worn about the torso of an individual (not shown), although it is to be recognized that the garment 10 could also be shaped to be worn as pants about the legs, a hat on a head, sleeves for arms, leggings for legs, gloves for hands, socks or shoes for feet, etc. Likewise, it is to be recognized that the garment 10 could be shaped to be worn around a body or portion thereof of an animal such as a horse, a dog, a pack animal, etc. In fact, the garment 10 need not necessarily be an article of clothing, and instead could be an external item such as a blanket or other covering device. In general, the design of the garment 10 and functional use thereof may be most any design and use, and such design and use are generally known or should be apparent to the relevant public and therefore need not be set forth herein in any detail.

As was alluded to above, the garment 10 may be designed to protect the individual against wind, rain, and similar adverse environmental conditions, and for example may be designed with an exterior fabric shell or the like that has low air permeability so as to prevent external air from being admitted. Additionally, the garment may be designed to include an insulating layer for added thermal warmth. However, such fabric shell and such insulating layer are not a requirement of the present innovation. That said, it may be that based on the presence of such fabric shell and/or insulating layer in the garment 10, or based on the presence of other constructs in the garment 10, the individual wearing the garment 10 may grow to become uncomfortable, perhaps by being overheated during activity, by perspiring during activity, by accumulating humidity during activity, etc. Accordingly, the vent panels 12 are provided in the garment 10 in an effort to alleviate such overheating, perspiration, humidity, and other similar discomforting factors.

As shown in FIGS. 1 and 2, the vent panels 12 are located in regions of the garment 10 that correspond to areas of the body that typically experience heightened discomfort. As may be appreciated, if as is shown the garment 10 is a jacket or the like for being worn about the torso of an individual, the areas of the body for which discomfort may be experienced include the armpits, the chest, and the upper, central, and lower back, and the vent panels 12 may thus be located in corresponding regions of the garment 10. As should be appreciated, such areas of discomfort and corresponding regions in the garment 10 may be most any appropriate areas and corresponding regions without departing from the spirit and scope of the present innovation. Such regions and areas are generally known or should be apparent to the relevant public, and therefore need not be set forth in detail in the present disclosure other than that which is provided.

Each vent panel 12 may be attached to the garment 10 in any appropriate manner without departing from the spirit and scope of the present innovation. Depending on circumstances, it may be advisable to sew the vent panel 12 directly to the garment or to otherwise permanently attach same, perhaps by way of a gluing or welding operation or the like. Alternately, it may be advisable to removably attach the vent panel, perhaps by way of a zippering arrangement, a hook-and-loop fastening arrangement, or the like. Attaching the vent panel 12 to the garment 10 is known or should be apparent to the relevant public and therefore need not be set forth herein in any detail other than that which is provided.

Generally, the garment 10 may be expected to have a primary interior surface and a primary exterior surface, among other things, where it is to be understood that the primary interior surface is that surface that faces toward and is closest to the body of the individual wearing the garment 10, and the primary exterior surface is that surface that faces away from and is farthest from the body of the individual wearing the garment 10. Empirically, it has been found that when the garment 10 is an over-garment such as a jacket or the like that is intended to be worn over another garment, each vent panel 12 works better when attached to the primary interior surface of such over-garment 10, as is the case in FIGS. 1 and 2.

Likewise, it has been found that when the garment 10 is an under-garment such as a shirt or the like that is intended to be worn next to the skin of the individual, each vent panel 12 works better when attached to the primary exterior surface of such under-garment 10. In particular, it has been found that by positioning each vent panel 12 away from the skin of the individual, the vent panel 12 is better able to circulate fluid about the individual and adjacent the vent panel 12 of the garment 10. Also, in the case where the garment 10 is an under-garment and is worn under another garment, attaching each vent panel 12 to the primary exterior surface of such garment 10 is more-or-less a functional equivalent to the case where the garment 10 is an over-garment worn over another garment and each vent panel 12 thereof is attached to the primary interior surface thereof, in that in both cases fluid is caused to flow between two layers of garment. Note though that if the garment 10 is a single layer worn by an individual without any other over- or under-garment, as may be the case during warm weather, the vent panel 12 should be attached to the primary interior surface of such garment 10 even though adjacent the skin of the individual. As will be set forth in more detail herein, the fluid circulated by each vent panel 12 is expected to be air, although other fluids may also be circulated without departing from the spirit and scope of the present innovation.

Figure 3:
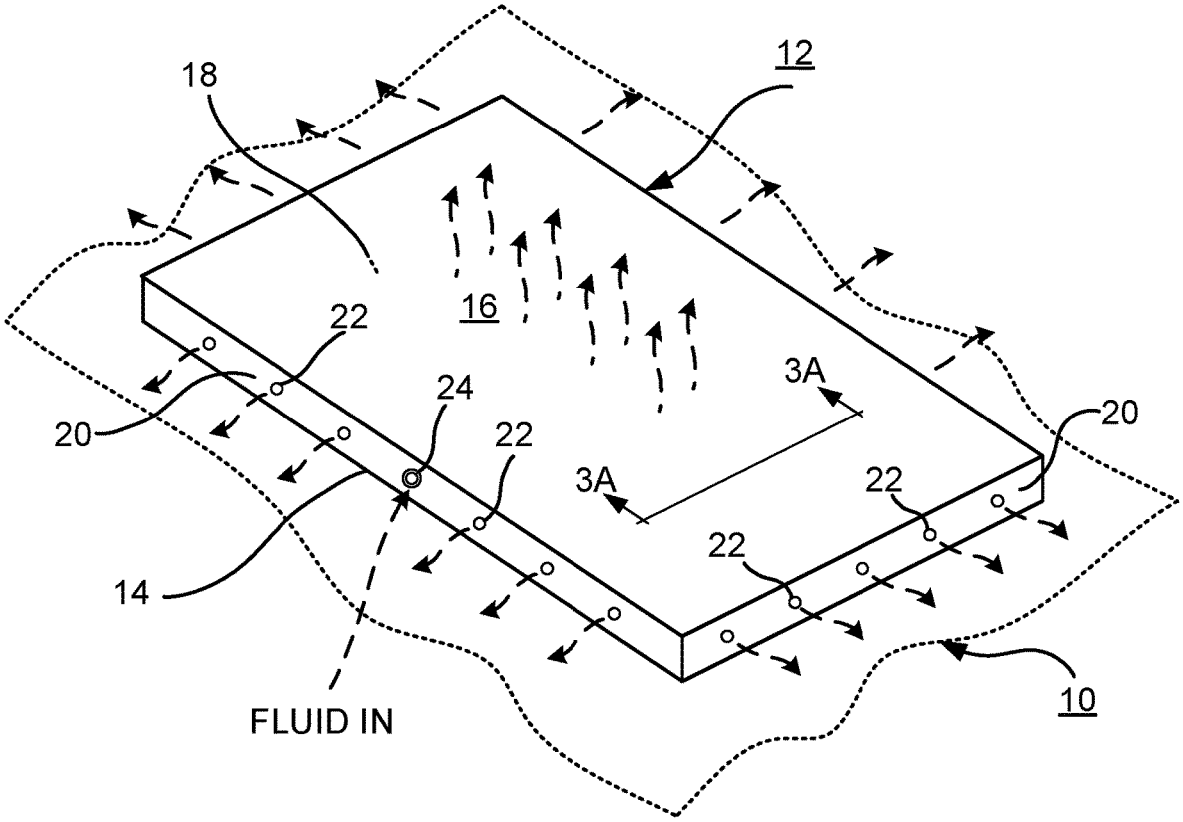
FIG. 3 is a partially cut-away perspective view of a vent panel from FIG. 1 and shows positive pressure flow therethrough in accordance with various embodiments of the present innovation.
Figure 3A:
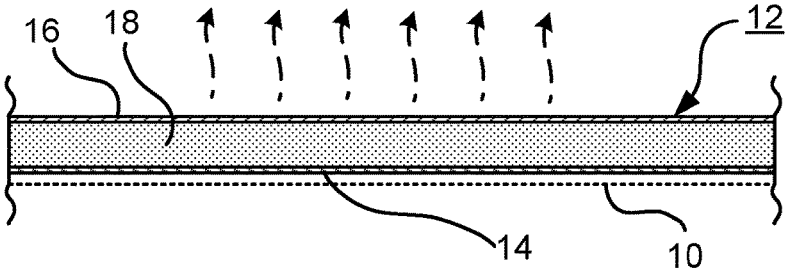
FIG. 3A is a cross-sectional view of the vent panel of FIG. 3 taken along the line 3A-3A thereof, and in particular shows the layers of the vent panel in relation to the garment in accordance with various embodiments of the present innovation.

Turning now to FIGS. 3 and 3A, it is seen that each vent panel 12 is generally of a multi-layer planar construction, with an impermeable attaching layer 14 at one face of the vent panel 12 which is intended to face toward the garment 10, a permeable diffusing layer 16 at the opposing face of the vent panel 12 which is intended to face away from the garment 10, and a circulation layer 18 interposed therebetween. Presumptively, the vent panel 12 and the layers 14, 16, and 18 thereof are generally flexible, at least enough so that the vent panel 12 is permitted to flex along with the garment 10 as attached thereto. Thus, the vent panel 12 does not impede the movement of the garment 10, such as may be advantageous if the garment is to be worn during exercise. The attaching layer 14 may for example be constructed from a plastic or elastomeric material or a lightweight woven fabric which is generally impermeable to the circulating fluid, be it air or otherwise, and correspondingly the diffusing layer 16 may for example be constructed from a plastic or elastomeric material or a knit/woven fabric with stretch which is indeed generally permeable to such circulating fluid, again be it air or otherwise.

As interposed between the attaching layer 14 and the diffusing layer 16, the circulation layer 18 may be constructed from a material that allows the circulating fluid, be it air or otherwise, to pass therethrough without undue constraint, and allow same to in fact circulate about the individual and adjacent the vent panel 12 within the garment 10. As an example, such circulation layer 18 may be constructed from a quilted microfilament yarn or the like, such that the circulation layer 18 is highly permeable to the circulating fluid, be it air or otherwise. One example of a product having such attaching layer 14, diffusing layer 16, and circulation layer 18 is Spacer Fabric as marketed by Springs Creative Products Group, LLC. of Rock Hill, South Carolina (https://www.springscreative.com/products/spacer-fabric/), or as marketed by Highland Industries of Greensboro, North Carolina (https://highlandindustries.com/products/hiflow-spacer-fabrics/), although it should be appreciated that other products may alternately be employed without departing from the spirit and scope of the present innovation.

As seen in FIG. 3 in particular, the vent panel 12 with the layers 14, 16, 18 may also be provided with a peripheral edge band 20 or the like in an effort to manage the circulation of fluid, be it air or otherwise, through the vent panel 12. As shown, the peripheral edge band 20 essentially wraps around the periphery of the vent panel 12 in an effort to at least somewhat seal the edges of the vent panel 12 and thus restrict the circulation of fluid, be it air or otherwise. Accordingly, such circulating fluid is directed to flow more through the circulation layer 18 of the vent panel 12. As should be appreciated, then, the edge band 20 may for example be constructed from a plastic or elastomeric material which is generally impermeable to the circulating fluid, be it air or otherwise. Likewise, such generally impermeable edge band 20 may for example be imparted to the vent panel by fusing the material of the vent panel 12 at the edges thereof, perhaps by way of a heat source or by way of sonic welding or the like.

That said, such edge band 20 may be made to be at least partially permeable, by selecting an appropriate material, or by being manufactured to include venting pores 22 or the like, where the vent pores 22 have appropriate diameters and appropriate spacing. Such diameters may for example be on the order of 2-3 mm and such spacing may be on the order of every 10-20 mm along the edge band 20. Judging an appropriate amount of permeability for the edge band 20 and manufacturing and/or introducing same into such edge band 20 is known or should be apparent to the relevant public and therefore need not be set forth herein in any detail beyond that which is provided. Accordingly, the edge band 20 may have any appropriate permeability and may be designed and manufactured in any appropriate manner without departing from the spirit and scope of the present innovation.

As may now be appreciated, each vent panel 12 within the garment 10 allows the circulation of fluid, be it air or otherwise, in one of at least two manners. In the first manner, and as shown in FIGS. 3 and 3A, positive pressure is introduced externally to the vent panel 12 in an effort to drive the circulating fluid (the directional arrows of FIG. 3) into the vent panel 12 by way of a port 24 thereof. As seen, the port 24 is located on or about the edge band 20 of the vent panel 12 and is in direct communication with the circulation layer 18 of the vent panel 12, although such port 24 may be located elsewhere if necessary and/or appropriate without departing from the spirit and scope of the present innovation. That said, locating the port 24 on or about the edge band 20 is believed to be advantageous in that the overall vent panel 12 may be generally flatter and accordingly less conspicuous. At any rate, upon being introduced into the vent panel 12 by way of the port 24, the circulating fluid then passes through the circulation layer 18 of the vent panel 12 and escapes therefrom and into the adjacent areas by way of the diffusing layer 16 of the vent panel and any venting pores 22 in the edge band 20 of the vent panel 12. Presumptively, such circulating fluid as supplied by the positive pressure is of a cooler and/or dryer nature than the environment within the garment 10, and thus provides a degree of comfort to the individual wearing same.

As might now be appreciated, in the second manner, which is in opposition to the manner shown in FIGS. 3 and 3A, negative pressure is introduced externally to the vent panel 12 in an effort to draw or pull the circulating fluid (the opposite of the directional arrows of FIGS. 3 and 3A) out of the vent panel 12 by way of the port 24 thereof. Thus, the circulating fluid is initially drawn from the adjacent areas by way of the diffusing layer 16 of the vent panel and any venting pores 22 in the edge band 20 of the vent panel 12, and then passes through the circulation layer 18 of the vent panel 12 and escapes from the vent panel 12 by way of the port 24. Here, it might be presumed that such circulating fluid as drawn out by the negative pressure is of a warmer and/or wetter nature than the environment outside the garment 10, and thus also provides a degree of comfort to the individual wearing same.

Depending on circumstances including use, function, manufacturability, and preference, among other things, it may be that either positive pressure or negative pressure is more suitable and/or desirable. Thus, if cooling is of primary importance, it may be that positive pressure is employed with the garment 10. Similarly, if humidity reduction is of primary importance, it may be that negative pressure is employed. Notably, circumstances may require a balancing of interests, wherein compromise is necessary. Thus, it may be that humidity reduction is desirable, but that the vent panels 12 are interior to a garment 10 that is to be worn against skin. In such case, negative pressure is more suitable to reduce the humidity, but may not be practical in that skin contact with the vent panels 12 would interfere with fluid flow as would otherwise be induced by such negative pressure. If so, it may be necessary to employ positive pressure rather than the more suitable negative pressure.

Note here that in either the first manner or the second manner, the circulation layer 18 should be of sufficient depth (top to bottom in FIG. 3A) so as to not impede the circulating fluid, but not so deep as to be perceived as being bulky or otherwise conspicuous. Such depth may of course vary based on many circumstances, but empirically it is believed that a depth of about 6-12 mm is sufficient in most cases.

With both the venting pores 22 in the edge band 20 of the vent panel 12 and the diffusing layer 16 in the vent panel 12, two kinds of circulation may be imparted within the garment. In particular, the venting pores 22 impart lateral flow along the surface of the garment 10, which is believed to be more likely to reduce humidity, and direct flow away from the surface of the garment 10, which is believed to be more likely to provide cooling. As should now be appreciated, depending on the location of the vent panel 12 and the function required thereby and thereat, and/or depending on personal preference, the circulation imparted thereby may be appropriately adjusted. For example, if lateral flow is desired at the expense of direct flow, the vent panel 12 may be constructed to have relatively more venting pores 22 and to have a relatively less permeable diffusing layer 16. Likewise, if direct flow is desired at the expense of lateral flow, the vent panel 12 may be constructed to have relatively less venting pores 22 and to have a relatively more permeable diffusing layer 16.

Figure 4:
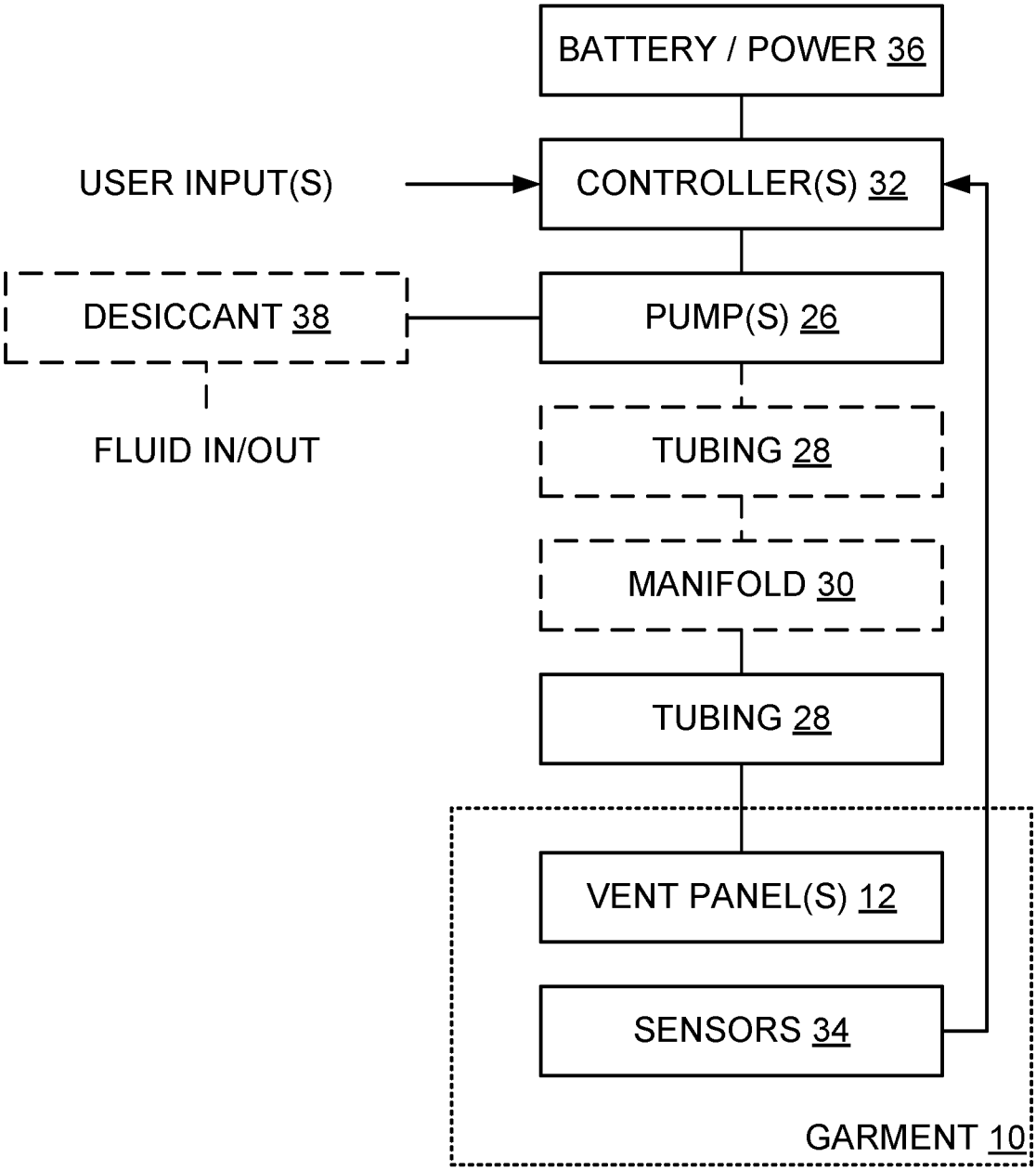
FIG. 4 is a block diagram of various components included with the vent panels of FIGS. 1-3 for operating same in accordance with various embodiments of the present innovation.

Turning now to FIG. 4, it is seen that the motive force that creates the positive or negative pressure is supplied by a pump 26 in various embodiments of the present innovation. As may be appreciated, the pump 26 may be any appropriate pump without departing from the spirit and scope of the present innovation, although it is to be appreciated that such pump should be small enough so as to be energy-efficient, lightweight, and inconspicuous, and yet large enough to be able to provide sufficient motive force. Selecting the appropriate pump 26 based on circumstances and design specifications is known or should be apparent to the relevant public, and therefore need not be set forth herein in any detail other than that which is provided.

In various embodiments of the present innovation, in order to satisfy the aforementioned goals, the pump 26 is an ultrasonic piezoelectric pump, such as for example one that is designed and/or marketed by TTP Ventus of Melbourn, Hertfordshire, United Kingdom (https://www.ttpventus-.com/products), or by CurieJet of Taiwan (http://www.curiejet.com/en/). As may be appreciated, using such an ultrasonic piezoelectric pump 26 is advantageous in many respects. In particular, such pump 26 has quiet (ultrasonic) operation at about 20-25 kHz, is free of vibration, is lightweight, and is relatively flat and inconspicuous and thus comfortable to wear. Moreover, such pump 26 is customizable and controllable, and is operated and cared for with ease. Thus, such pump 26 can be integrated into the garment 10 without undue difficulty.

The general characteristics of the pump 26 may be expected to vary depending on circumstances and applications. That said, it likely is the case that the pump 26 should be removable or detachable, so that the garment 10 can be washed, for example. Also, the pump 26 should have a flow rate of about 0 to 5 liters/minute in the case of air, controllable by the individual wearing the garment 10, and an exit flow velocity between 1 and 10 meters/sec, also in the case of air. The body of the pump 26 should be about 1-10 grams in mass, operate at temperatures between 10 and 120 degrees F., and have an output/input pressure of about 1 to 10 psi.

As shown in FIG. 4, the pump 26 may be coupled to the vent panel 12 within the garment 10 by way of a conduit such as an appropriate length of flexible tubing 28 which, as should be understood is appropriately routed within the garment 10 and between such pump 26 and such vent panel 12. Thus, the pump 26 may in fact be located somewhat remotely from the vent panel 12, presuming that the tubing 28 is of sufficient character to accommodate such an arrangement. In particular, the tubing 28 should be large enough to provide a relatively unimpeded flow of the circulating fluid, and yet not so large as to become conspicuous or bulky. Also, the tubing 28 should be flexible to accommodate the flexibility of the garment 10, and yet should have sufficient structural integrity so as to not collapse or otherwise block the flow of the circulating fluid. Within such parameters, the tubing 28 may be any appropriate tubing without departing from the spirit and scope of the present innovation. For example, the tubing 28 may be constructed from an impermeable plastic or elastomeric material, with an inner diameter of about 2-5 mm. Selecting the appropriate tubing 28 based on circumstances and design specifications is known or should be apparent to the relevant public, and therefore need not be set forth herein in any detail other than that which is provided.

Presumptively, the pump 26 operates based on drawing circulating fluid in from the environment external to the garment 10, if creating the aforementioned positive pressure, or based on expelling circulating fluid out to the environment external to the garment 10, if creating the aforementioned negative pressure. In either case, the pump 26 is presumptively located external to the garment 10 or has appropriate access thereto, perhaps by way of other tubing, ducting, or the like. In any event, it may be necessary and/or appropriate that either the tubing 28 between the pump 26 and the vent panel 12 or other tubing, ducting, or the like is required to breach the garment 10 in order to gain access to the interior thereof. However, it has been empirically found that such breaching is oftentimes unnecessary, and can be avoided by careful routing. Moreover, such breaching should be avoided if possible, especially if such breaching would be aesthetically unpleasing, or would tend to allow for water leakage, among other things.

In general, locating the pump 26, the tubing 28, and any other tubing, ducting, or the like in relation to the garment 10 may be done in any appropriate manner without departing from the spirit and scope of the present innovation, bearing in mind that the pump 26 in particular should be located in an area where overheating is avoided. For example, it may be that the pump 26 is in a pocket of the garment 10 and the tubing 28 snakes therefrom through and into the garment 10 to the vent panel 12. Likewise, it may be that the pump 26 is located externally on a sleeve of the garment 10 and the tubing snakes down the exterior of sleeve, through an armhole, and then up the interior of the sleeve toward the vent panel 12. Selecting the locations and routings may be done based on circumstances and design specifications, and is known or should be apparent to the relevant public, and therefore need not be set forth herein in any detail other than that which is provided.

Although thus far disclosed in terms of a single pump 26 and a single tubing 28 communicating same with a single vent panel 12, it is to be appreciated that multiple pumps 26, tubings 28, and vent panels 12 may be configured in a garment 10 without departing from the spirit and scope of the present innovation, as is alluded to in FIG. 4. As but one example, it may be that the garment 10 has three vent panels 12, each with a tubing 26 interposed between same and a common manifold 30, and also another tubing interposed between the manifold 30 and a single pump 26. Also, it may be that each vent panel 12 has a corresponding pump 26 dedicated thereto and in communication therewith by way of a dedicated tubing 28 (not shown), in which case no manifold 30 is believed to be necessary. Likewise, it may be that a single pump 26 is arranged to be in communication with a plurality of serially arranged vent panels 12 by way of appropriate connective tubing 26 (also not shown), in which case no manifold 30 is believed to be necessary. Accordingly, and as should be understood, configuring pumps 26, tubings 28, manifolds 30, and vent panels 12 within a garment 10 may be done based on circumstances and design specifications, and is known or should be apparent to the relevant public, and therefore need not be set forth herein in any detail other than that which is provided.

Still referring to FIG. 4, it is seen that each pump 26 is controlled by an appropriately configured controller 32. As may be appreciated, each pump 26 may be controlled by its own dedicated controller 32, or a single controller 32 may control multiple pumps 26, all without departing from the spirit and scope of the present innovation. Notably, each controller 32 may be a relatively simple device that controls each pump 26 thereof based on one or a few parameters selected by the individual wearing the garment 10, such as flow rate, or may be a more sophisticated device that controls each pump 26 thereof based on multiple parameters, perhaps based on a programmable control unit or the like. Accordingly, and as should be understood, the type and level of control provided by the controller 32 may be decided based on circumstances and design specifications, and is known or should be apparent to the relevant public, and therefore need not be set forth herein in any detail other than that which is provided.

If indeed multiple pumps 26 are employed with multiple vent panels 12 in the garment 10, it may be that the pumps 26 and vent panels 12 are arranged to circulate fluid adjacent the garment 10 from one vent panel 12 to another vent panel 12. As such, one pump 26 may introduce positive pressure to the one vent panel 12, and another pump 26 may introduce negative pressure to the another vent panel 12, in an effort to drive the circulating fluid therebetween. In doing so, and as should now be appreciated, the circulating fluid as supplied by the positive pressure from the one pump 26 can be employed to cool the environment within the garment 10, can accumulate humidity from such environment within such garment 10, and can then be drawn out by the negative pressure from the another pump 26. Such an arrangement is believed to be advantageous inasmuch as fluid circulation within the garment 10 is improved, and is believed to be more efficient.

As shown in FIG. 4, the controller 32 may be operated based on user inputs from the individual wearing the garment 10, and based on feedback from one or more sensors 34 placed within the garment 10, including one or more temperature sensors 34 and one or more humidity sensors 34, among other things. Such user inputs may be any appropriate inputs without departing from the spirit and scope of the present innovation. For example, such user inputs may include on/off control, flow rate control, percentage of max flow rate control, outlet pressure control, inlet pressure control, humidity control, and/or the like, among other things.

Generally, based on such inputs and such sensors 34, it may be that as temperature and humidity increase, the controller 32 operates the pump 26 to increase the circulation of fluid through each connected vent panel 12, and likewise as temperature and humidity decrease, the controller 32 operates the pump 26 to decrease the circulation of fluid through each connected vent panel 12, all in an effort to reach a desired level as set by the inputs from the individual. As may be appreciated, the sensors 34 and operating the controller 32 based thereon may be performed in any appropriate manner without departing from the spirit and scope of the present innovation. Such operating is known or should be apparent to the relevant public, and therefore need not be set forth herein in any detail other than that which is provided.

As is also shown in FIG. 4, a battery or other power source 36 may be provided to operate the pump 26, the controller 32, and other related elements. As should be expected, the power source 36 should be of sufficient capacity to operate for at least a few hours if not 8-10 hours, but should not be so large as to be too heavy and/or bulky, especially inasmuch as the individual wearing the garment 10 will be carrying such power source 36 too. Although the power source 36 may be most any appropriate power source without departing from the spirit and scope of the present innovation, it is generally expected that the power source 36 may be in the nature of a rechargeable lithium-ion battery or the like that is lightweight and can be recharged in a few hours, perhaps by way of a USB connector or the like. Such a power source 36 is known or should be apparent to the relevant public, and therefore need not be set forth herein in any detail other than that which is provided.

Presumptively, the power source 36, the controller 32, and the pump 26 may be located relatively closely with respect to each other, especially if there is no countervailing reason. That said, it may nevertheless be the case that such items may be remotely located from each other, perhaps if necessary to balance out the weight of the items across the individual wearing the garment 10, or if necessary to effectuate connections therebetween. As before with regard to the pump 26 and the vent panel 12, care should be taken in connecting such items to among other things avoid unnecessarily breaching the garment 10, and also to avoid placing the connections within the garment 10 in a manner that may be perceived as uncomfortable by the individual wearing the garment 10.

In operation, the pump 26 in particular may on occasion be required to draw in relatively humid external air for delivery to the vent panel 12 within the garment 10. Especially if humidity within the garment 10 is a concern, and in various embodiments of the present innovation, a desiccant 38 may be provided at the intake to the pump 26, as is shown in FIG. 4. Accordingly, the desiccant 38 acts to dry the humid air prior to exposing same to the pump 26 itself and also to the vent panel 12 and the interior of the garment 10. Thus, humidity within the garment 10 is hopefully not exacerbated by the relatively humid external air, and also the pump 26 and the vent panel 12 are protected from any harmful effects that may occur based on exposure to such relatively humid external air. As should be understood, the desiccant 38 may be most any appropriate desiccant without departing from the spirit and scope of the present innovation, and such desiccant 38 is known or should be apparent to the relevant public, and therefore need not be set forth herein in any detail other than that which is provided.

FURTHER EMBODIMENTS

In the course of developing the garment 10 and constituent components thereof as has thus far been set forth above, it has been found that multiple further embodiments of the vent panel 12 in particular are available and advantageous. In particular, although the vent panel 12 as is shown in FIG. 3 et seq. and disclosed in connection therewith is highly useful, such vent panel 12 can be simplified and/or improved so as to among other things be constructed with greater ease and/or be made more efficient in operation, among other things, as will be set forth below.

Figure 5:
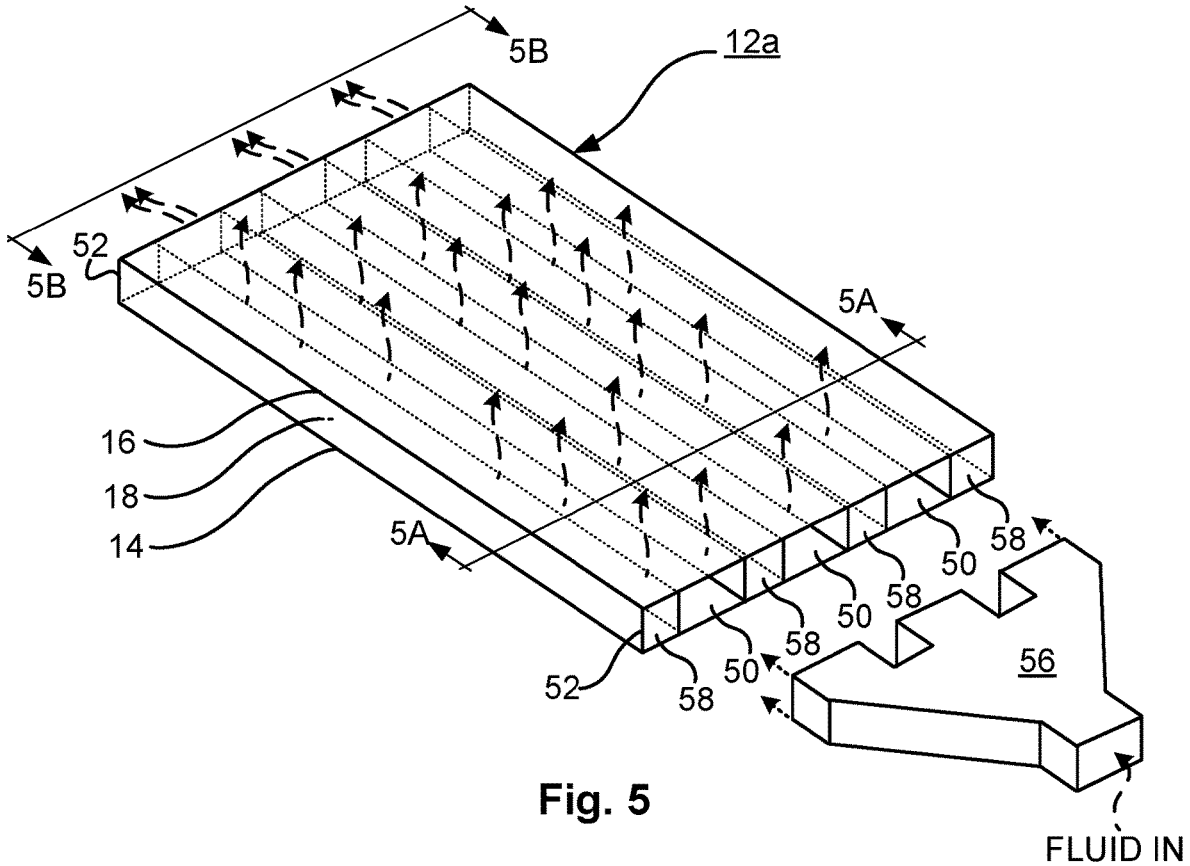
FIG. 5 is a perspective view of a vent panel akin to that of FIG. 1 and shows positive pressure flow therethrough in accordance with further embodiments of the present innovation.
Figure 5A:
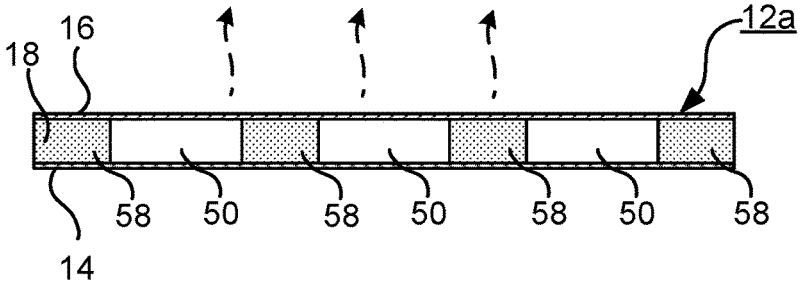
FIG. 5A is a cross-sectional view of the vent panel of FIG. 5 taken along the line 5A-5A thereof, and in particular shows the layers of the vent panel in accordance with further embodiments of the present innovation.

Specifically, and turning now to FIG. 5, it is seen that in further embodiments of the present innovation, a vent panel 12*a* may be employed in the garment 10 (omitted for clarity in FIG. 5 et seq.), where the vent panel 12*a* is mainly characterized as defining a plurality of generally linear and generally parallel channels 50 that extend between generally opposing peripheral edges 52 of the vent panel 12*a*. As seen in FIGS. 5 and 5A, three such channels 50 are shown, although it is to be appreciated that more or less channels 50 may also be employed without departing from the spirit and scope of the present innovation.

With such channels 50, and as should be appreciated by the relevant public, the vent panel 12*a* in orthogonal cross-section (FIG. 5A) is similar if not substantially identical regardless of where the orthogonal cross-section of FIG. 5A is taken, and as a result the vent panel 12*a* may be more easily manufactured as a continuous process, perhaps in the manner of a continuous extrusion or the like if deemed necessary and/or advisable. Of course, other methods of manufacture of the vent panel 12*a* and other geometries for the channels 50 may be employed without departing from the spirit and scope of the present innovation.

As before, the vent panel 12*a* of FIGS. 5 and 5A is generally of a multi-layer planar construction, with an impermeable attaching layer 14 at one face of the vent panel 12*a* which is intended to face toward the garment 10, a permeable diffusing layer 16 at the opposing face of the vent panel 12*a* which is intended to face away from the garment 10, and a circulation layer 18 interposed therebetween, where the channels 50 are defined within the circulation layer 18. Also as before, the vent panel 12*a* and the layers 14, 16, and 18 thereof are generally flexible, at least enough so that the vent panel 12*a* is permitted to flex along with the garment 10 as attached thereto. Thus, the vent panel 12 does not impede the movement of the garment 10, such as may be advantageous if the garment is to be worn during exercise. The attaching layer 14 again should be constructed from a plastic or elastomeric material or a lightweight woven fabric which is generally impermeable to the circulating fluid, be it air or otherwise, and correspondingly the diffusing layer 16 again should be constructed from a plastic or elastomeric material or a knit/woven fabric with stretch which is indeed generally permeable to such circulating fluid, again be it air or otherwise.

As interposed between the attaching layer 14 and the diffusing layer 16, the circulation layer 18 of the vent panel 12*a* may define the channels 50 therein in any appropriate manner without departing from the spirit and scope of the present innovation. Presumptively, each channel 50 defined in the vent panel 12*a* is open space demarcated by the absence of any material from the circulation layer 18 or otherwise, although it is to be appreciated that each channel 50 may alternately be defined from some sort of material within the circulation layer 18 without departing from the spirit and scope of the present innovation. In the latter case, it may be that the material defining each channel 50 is relatively diaphanous or gossamer so as to avoid impeding the flow of the circulating fluid therethrough, as much as is possible.

Here, the channels 50 and the circulation layer 18 defining same allow the circulating fluid, be it air or otherwise, to pass therethrough without undue constraint, both in a lateral flow from one peripheral edge 52 to the other peripheral edge 52, and in a direct flow through the circulation layer 18 of the vent panel 12*a* and past the diffusing layer 16 of the vent panel 12*a*. As should be appreciated by the relevant public, the amount of lateral flow and direct flow and the proportion therebetween may be controlled through judicious selection of the dimensions and number of the channels 50 and also by the judicious selection of the permeability of the circulation layer 18 and diffusing layer 16 of the vent panel 12*a*. Such judicious selection should be known or apparent to the relevant public, and therefore need not be set forth herein in any detail other than that which is provided.

Figure 5B:
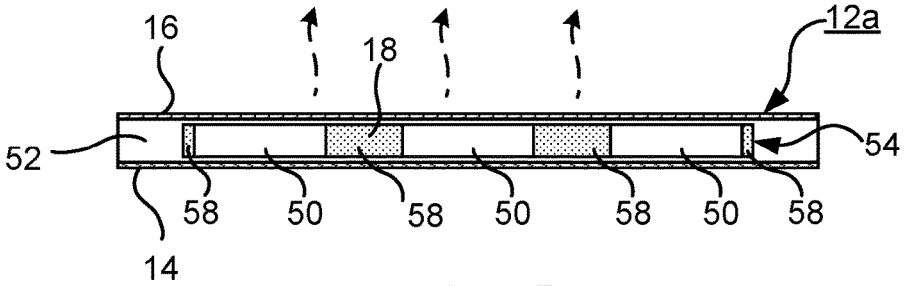
FIG. 5B is an end-on view of the vent panel of FIG. 5 taken along the line 5B-5B thereof, and in particular shows the opening at one peripheral edge of the vent panel in accordance with further embodiments of the present innovation.

As seen in FIG. 5 in particular, the vent panel 12*a* with the layers 14, 16, 18 need not necessarily be provided with the peripheral edge band 20 and venting pores 22 of the vent panel 12 of FIG. 3, if deemed necessary and/or advisable. Instead, the lateral flow along the surface of the garment 10 imparted by such vent pores 22 with regard to the vent panel 12 of FIG. 3 may instead be effectuated by an opening 54 (FIG. 5B) defined at one of the peripheral edges 52 of the vent panel 12*a*, where each channel 50 communicates externally from the vent panel 12*a* through the opening 54 in an effort to manage the circulation of fluid, be it air or otherwise, through such vent panel 12*a*. As may be appreciated, the opening 54 may merely be defined at the peripheral edge 52 thereof without any specific defining structure, or may be implemented with the aid of such a specific defining structure, such as a frame or insert of appropriate size and construction, without departing from the spirit and scope of the present innovation. As has been shown empirically, such opening 54 if judiciously dimensioned provides a sufficient amount of such lateral flow. As before, such judicious dimensioning should be known or apparent to the relevant public, and therefore need not be set forth herein in any detail other than that which is provided. Significantly, if the peripheral edge band 20 and venting pores 22 are omitted from the vent panel 12*a* of FIG. 5, a significant cost savings may be obtained both from simplified manufacturing and a reduction in materials required, as should be apparent to the relevant public.

As should be appreciated, and as is shown in FIG. 5 et seq., the circulating fluid is communicated between the pump(s) 26 (not shown in FIG. 5 et seq.) and the vent panel 12*a* by way of a panel manifold 56 interposed therebetween, where the panel manifold 56 is attached to the vent panel 12*a* at the peripheral edge 52 thereof opposite the peripheral edge 52 defining the opening 54. As seen in FIG. 5, the panel manifold 56 is exploded from the peripheral edge 52, although it is to be appreciated that in normal operation such panel manifold 56 may be fitted to the peripheral edge 52, perhaps by way of an interference fit or another fitting mechanism. As such, and as should be understood, the channels 50 of the vent panel 12*a* are interposed between the opening 54 and the panel manifold 56 such that at least a portion of the circulating fluid travels through the vent panel 12*a* between the opening 54 and the panel manifold 56. Notably, and as is shown, the panel manifold 56 is external from the vent panel 12*a* so as to simplify same. That said, the panel manifold 56 may alternately be integral with the vent panel 12*a* without departing from the spirit and scope of the present innovation. As should be understood, whether external or integral, the mechanism for coupling the panel manifold 56 and the vent panel 12*a* should be apparent to the relevant public based on the present disclosure, and accordingly the details thereof need not be set forth herein other than that which is provided.

Also notably, and as should be appreciated, the panel manifold 56 defines a plurality of channel orifices, each channel orifice for being in communication with a respective channel 50 of the vent panel 12*a*, as well as at least one pump orifice for being in communication with at least one respective pump 26 by way of appropriate tubing 28 or the like (not shown in FIG. 5 et seq.), so that the circulating fluid is communicated between the channels 50 of the vent panel 12*a* and the at least one respective pump 26. As should be understood, the panel manifold 56 may be of any appropriate design and construction without departing from the spirt and scope of the present innovation, as long as the circulating fluid is indeed communicated between the pump(s) 26 and the vent panel 12*a* in the manner intended. Such design and construction of such panel manifold 56 is known or should be apparent to the relevant public, and therefore need not be set forth herein in any detail other than that which is provided.

As before with regard to the vent panel 12 of FIG. 3, the vent panel 12*a* within the garment 10 allows the circulation of fluid, be it air or otherwise, in one of at least two manners. In the first manner, and as shown in FIG. 5 et seq., positive pressure is introduced externally to the vent panel 12*a* in an effort to drive the circulating fluid (the directional arrows of FIG. 5) into each channel 50 of the vent panel 12*a* by way of a pump 26 and the panel manifold 56. Thereafter, at least a first portion of the positively pressured circulating fluid travels through each channel and across the vent panel 12*a* to exit from the opening 54 thereof as the aforementioned lateral flow, and at least a second portion of the positively pressured circulating fluid travels through each channel 50, into the circulation layer 18 of the vent panel 12*a* and exits the vent panel 12*a* from the diffusing layer 16 thereof as the aforementioned direct flow.

Likewise, in the second manner, which is in opposition to the manner shown in FIG. 5 et seq., negative pressure is introduced externally to the vent panel 12*a* in an effort to draw or pull the circulating fluid (the opposite of the directional arrows of FIG. 5) out from each channel 50 of the vent panel 12*a* by way of a pump 26 and the panel manifold 56. As should now be evident, at least a first portion of the negatively pressured circulating fluid travels from the opening 54 into each channel 50 and across the vent panel 12*a* to the panel manifold 56 as the aforementioned lateral flow, and at least a second portion of the negatively pressured circulating fluid travels from the diffusing layer 16 of the vent panel 12*a* by way of the circulation layer 18 of such vent panel 12*a* into each channel 50 and then to the panel manifold 56 as the aforementioned direct flow. As before, it might be presumed that such circulating fluid as drawn out by the negative pressure is of a warmer and/or wetter nature than the environment outside the garment 10, and thus also provides a degree of comfort to the individual wearing same.

Also as before, in either the first manner or the second manner, the circulation layer 18 of the vent panel 12*a* in particular and the overall vent panel 12*a* in general should be of sufficient depth (top to bottom in FIG. 3A) so as to not impede the circulating fluid, but not so deep as to be perceived as being bulky or otherwise conspicuous. Such depth may of course vary based on many circumstances, but empirically it is believed that a depth of about 6-20 mm is sufficient in most cases.

In the vent panel 12*a* of FIG. 5 et seq., and referring now to FIG. 5A in particular, it is seen that in various embodiments of the present innovation the circulation layer 18 of the vent panel 12*a* is formed as a plurality of pillars 58, where each pillar 58 extends generally between the attaching layer 14 and the diffusing layer 16 (vertically in the orthogonal cross-section of FIG. 5A), and is spaced a distance from at least one adjacent pillar 58 to define therebetween a channel 50 of the vent panel 12*a*. Thus, and as should now be apparent, the pillars 58 and channels 50 generally laterally alternate within the vent panel 12*a* of FIG. 5 et seq. Each pillar 58 of the circulation layer 18 of the vent panel 12*a* should be relatively incompressible at least in the vertical direction so as to resist vertical crushing and vertical deformation of the defined channels 50, and accordingly may be manufactured from an open- or closed-cell foam or a three-dimensional fabric, among other things. Of course, other materials may be employed for the pillars 58 without departing from the spirit and scope of the present innovation. Such other materials are known or should be apparent to the relevant public and therefore need not be set forth herein in any detail other than that which is provided.

Particularly where negative pressure is introduced externally to the vent panel 12*a* in an effort to draw or pull the circulating fluid (the opposite of the directional arrows of FIG. 5) out from each channel 50 of the vent panel 12*a*, it may be that the pillars 58 and the diffusing layer 16 are constructed from a wicking material that can draw not only circulating fluid that originates from within the garment 10 but moisture within and about such circulating fluid. Accordingly, and as should be evident, the vent panel 12*a* with such wicking material may be employed in an effort to reduce humidity and the like from within such garment 10. Such wicking material is known or should be apparent to the relevant public and therefore need not be set forth herein in any detail other than that which is provided.

Figure 6A:
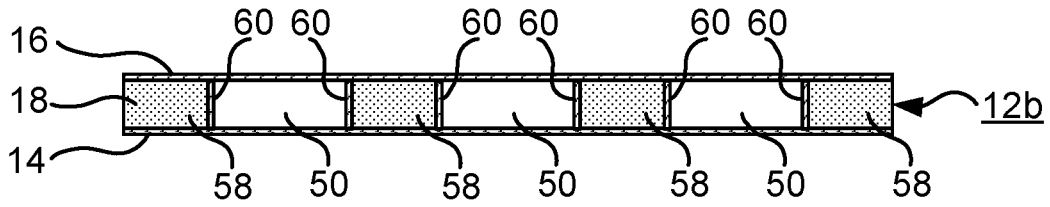
FIGS. 6A-6E are each cross-sectional views akin to that of FIG. 5A, and in particular each shows an alternate arrangement of the layers of the vent panel of FIG. 5 in accordance with further embodiments of the present innovation.
Figure 6B:
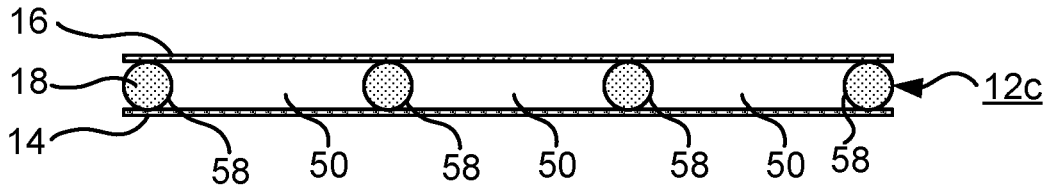
Figure 6C:
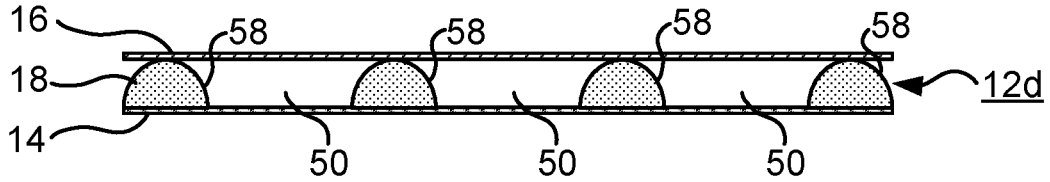
Figure 6D:
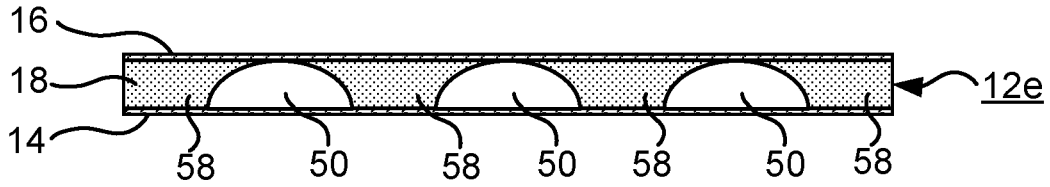
Figure 6E:
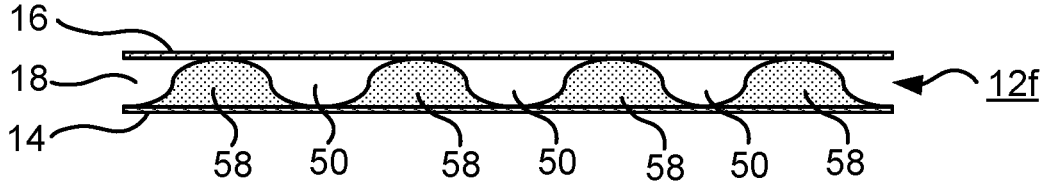

Alternately, and as seen in FIG. 6A, it may be that the pillars 58 are not constructed from such a wicking material but instead are lined with a wicking liner 60 that is in communication with the adjacently defined channel(s) 50 and the diffusing layer 16 of the vent panel 12*b*. As shown in the orthogonal cross-section of FIG. 6A, each pillar 58 on either lateral side thereof has such a wicking liner 60 interposed between the pillar 58 and the adjacent channel 50, where the interposed wicking liner 60 extends vertically between the attaching layer 14 and the diffusing layer 16, so as to communicate moisture from the diffusing layer 16 of the vent panel 12*b* to the adjacent channel 50. Presumptively, each wicking liner 60 would also extend longitudinally along the adjacent channel 50. As should be evident, the vent panel 12*b* with such wicking liners 60 can employ pillars 58 formed from a differing, perhaps non-wicking material, where the differing material of the pillars 58 may for example be better suited to resist vertical crushing, among other things. The wicking liners 60 may be formed from a wicking material that is known or should be apparent to the relevant public and therefore need not be set forth herein in any detail other than that which is provided, and likewise the wicking liners 60 may be formed into the vent panel 12*b* in a manner that is known or should be apparent to the relevant public and therefore need not be set forth herein in any detail other than that which is provided.

Although the pillars 58 and channels 50 defined thereby may have most any appropriate dimensions without departing from the spirit and scope of the present innovation, it has been empirically found that good results may be achieved if each pillar 58 in orthogonal cross-section is about 3-15 mm vertically (up and down in the orthogonal cross-section of FIG. 6A) and about 5-15 mm horizontally (side to side in the orthogonal cross-section of FIG. 6A), if each pillar 58 defines a channel 50 that in orthogonal cross-section is about 3-15 mm vertically and about 5-150 mm horizontally, if each of the attaching layer 14 and the diffusing layer 16 in orthogonal cross-section is about 0.5-3 mm vertically, if the number of channels 50 defined in the vent panel 12*a* is about 3-7 or perhaps even a single channel, and if each defined channel 50 is in length about 50-800 mm. Of course, other dimensions and arrangements may be employed without departing from the spirit and scope of the present innovation. Such dimensions are known or should be apparent to the relevant public and therefore need not be set forth herein in any detail other than that which is provided.

Turning now to FIGS. 6B-6E, it is seen that in alternate embodiments of the present innovation, the pillars 58 may in orthogonal cross-section have differing geometries. In particular, and turning now to FIG. 6B, it may be that the pillars 58 in orthogonal cross-section are generally circular or at least oval in shape. As may be appreciated, such circular or oval pillars 58 can be advantageous if for example the pillars 58 are previously extruded (not shown) or otherwise provided in such circular or oval form, and then the vent panel 12*c* is formed by sandwiching such circular or oval pillars 58 between the attaching layer 14 and the diffusing layer 16. Alternately, and turning now to FIGS. 6C-6E, it may be that the pillars 58 in orthogonal cross-section are upwardly arched (vent panel 12*d* of FIG. 6C) or downwardly arched (not shown), or that the pillars 58 in orthogonal cross-section define channels 50 in orthogonal cross-section that are upwardly arched (vent panel 12*e* of FIG. 6D) or downwardly arched (not shown), or that the pillars 58 and channels 60 in orthogonal cross-section and in combination exhibit a corrugation in the manner of a sinusoidal wave extending laterally (vent panel 12*f* of FIG. 6E). As may be appreciated, any of the arrangements of FIGS. 6B-6E may be advantageous, depending on circumstances, for example in the manufacture or use of the vent panels 12*c*, 12*d*, 12*e*, 12*f*, among other things.

Note here that the pillars 58 of the vent panels 12*c*, 12*d*, 12*e*, 12*f* of FIGS. 6B-6E likely are not lined with any wicking liner 60 such as that of the vent panel 12*b* of FIG. 6A, although such lining may nevertheless occur without departing from the spirit and scope of the present innovation. Note too, that the methods of manufacturing any of the vent panels 12*a*-12*f* are known or should be apparent to the relevant public, and therefore need not be set forth herein in any detail other than that which is provided.

Figure 7:
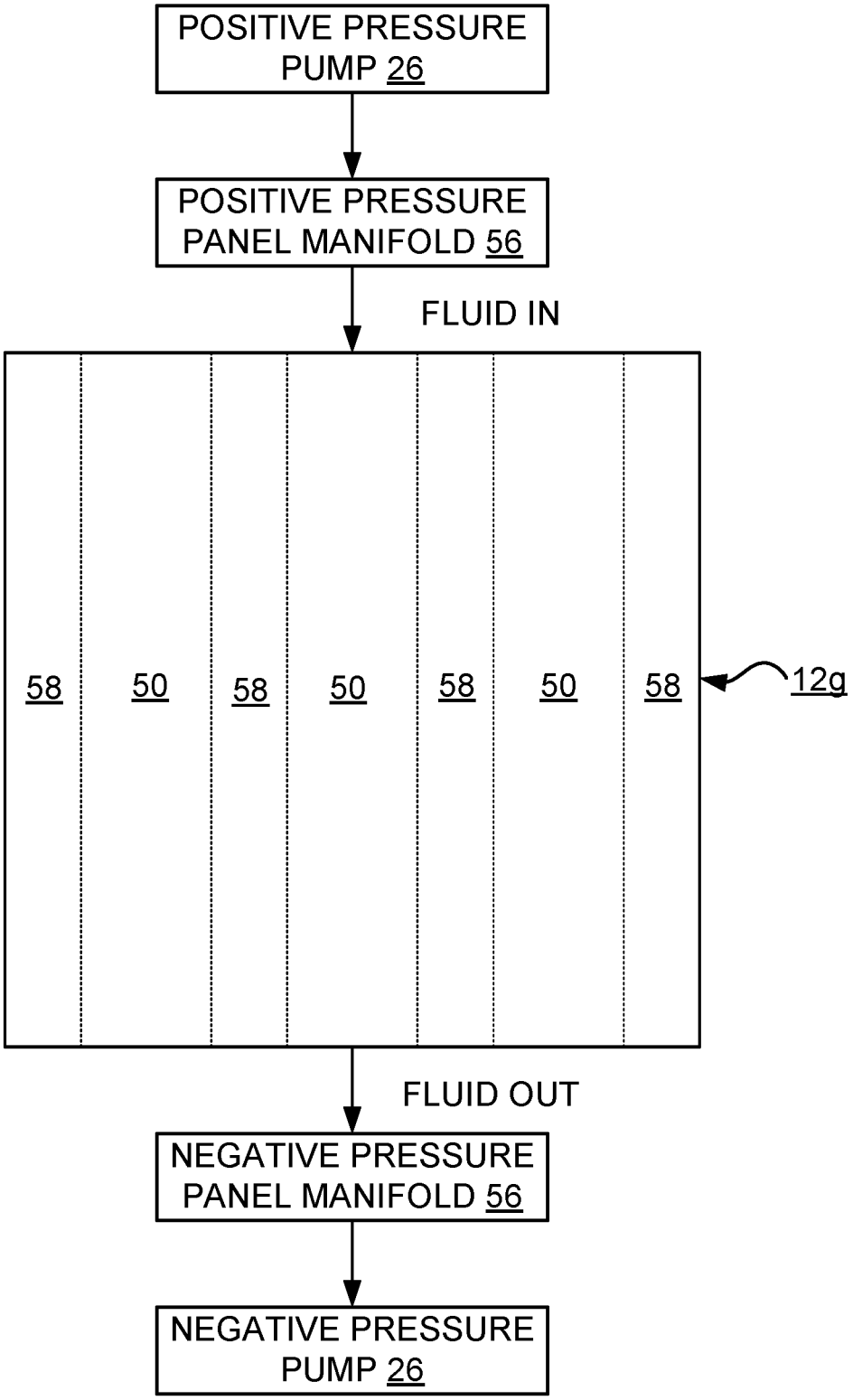
FIG. 7 is a block diagram of various components including the vent panel of any of FIGS. 5 and 6A-6E, and in particular shows the vent panel having both positive and negative pressure applied thereto at opposing ends thereof in accordance with further embodiments of the present innovation.

Turning now to FIG. 7, it is seen that in one embodiment of the present innovation a vent panel 12*g* is provided, where the opening 54 of the vent panel 12*a* is replaced with another panel manifold 56, such that a first one of the panel manifolds 56 introduces a positive pressure to the vent panel 12*g* from a first (positive pressure) pump 26, and such that a second one of the panel manifolds 56 introduces a negative pressure to the vent panel 12*g* from a second (negative pressure) pump 26. Accordingly, the first and second pumps in combination both drive the circulating fluid into the vent panel 12*g* and draw the circulating fluid out from the same vent panel 12*g*. Thus, and as should be appreciated, the flow of the circulating fluid within the vent panel is increased, and the cooling effect provided by same to the garment 10 is likewise increased.

As should be evident, it may be that by applying positive pressure at one side of the vent panel 12*g* of FIG. 7 and negative pressure at the other side of such vent panel, substantially all of the circulating fluid may travel in the channels 50 therebetween without much opportunity for such circulating fluid to travel through the circulation layer 18 of the vent panel 12*g* and exit or enter the vent panel 12*g* from the diffusing layer 16 thereof. Nevertheless, if such vent panel 12*g* is designed to wick moisture from within the garment 10 and into communication with the channels 50 thereof, such communicated moisture may be more effectively removed from the vent panel 12*g* in such an arrangement. Of course, other arrangements may be employed in connection with the vent panel 12*g* of FIG. 7 without departing from the spirit and scope of the present innovation.

In any of the embodiments set forth herein, it is to be appreciated that although reference may be made to an element as a single element or as a set number of elements, such element may alternately appear as other numbers of elements without departing from the spirit and scope of the present innovation. For example, with regard to the panel manifold 56 such as has been set forth above in connection with FIG. 5 et seq., only a single panel manifold 56 is shown in FIG. 5 in particular, although other numbers of panel manifolds 56 may alternately be employed. Thus, it may be that in a particular instance, two manifolds 56, each having two channel orifices, may be employed in connection with a vent panel 12*a* or the like having four channels 50, with appropriate modification, to name one of many possible variations.

More generally, then, all manner of alternate arrangements of panel manifolds 56, channel orifices and pump orifices thereof, pumps 26, openings 54, channels 50, pillars, 58, etc. may be employed without departing from the spirit and scope of the present innovation. As but a few examples: a single panel manifold 56 may have two pump orifices, each pump orifice in communication with a separate one of a plurality of pumps; multiple panel manifolds 56 may each have a channel orifice in communication with a common channel 50; a plurality of openings 54 may be provided, each opening 54 in communication with a single channel 50 or in communication with more than one channel 50; etc. As should be appreciated, rationales for such alternate arrangements and details for effectuating same are known or should be apparent to the relevant public and therefore need not be set forth herein with any detail beyond that which is already provided.

Pump-Conditioning Garment about Torso

Particularly in the case where the garment 10 is to be worn about the torso of a body of an individual or the like, it has been found that multiple further embodiments are available and advantageous. In particular, when the individual is experiencing especially high levels of heat stress, such as for example a surgeon operating on a patient, or a soldier in a combat zone or the like, or a hiker engaging in a trek or the like, specialized cooling solutions or the like may be required. With regard to a surgeon, for example, such surgeon may be required to stand for hours in an operating theater under bright lights and wear several layers about the torso thereof, including underwear, scrubs (i.e., surgical coveralls), and protective equipment such as germ-protection clothing and/or radiation-protection clothing, among other things. For such surgeon in particular, the aforementioned heat stress may manifest as profuse sweating and drenched scrubs, which may be distracting and interfere with the ability of the surgeon to devote his or her full attention to the patient thereof. While the garment 10 as is shown in FIG. 1 et seq. and disclosed above may be worn by the surgeon in an effort to achieve cooling and dehumidifying, such garment 10 within a sterile surgical environment suffers from several deficiencies. For one thing, the garment 10 does not direct the flow of circulating fluid in a strategic manner best suited to such surgical environment. For another thing, the garment 10 in use can potentially spread germs and other biologic materials outward from the surgeon and toward the patient.

Figure 8:
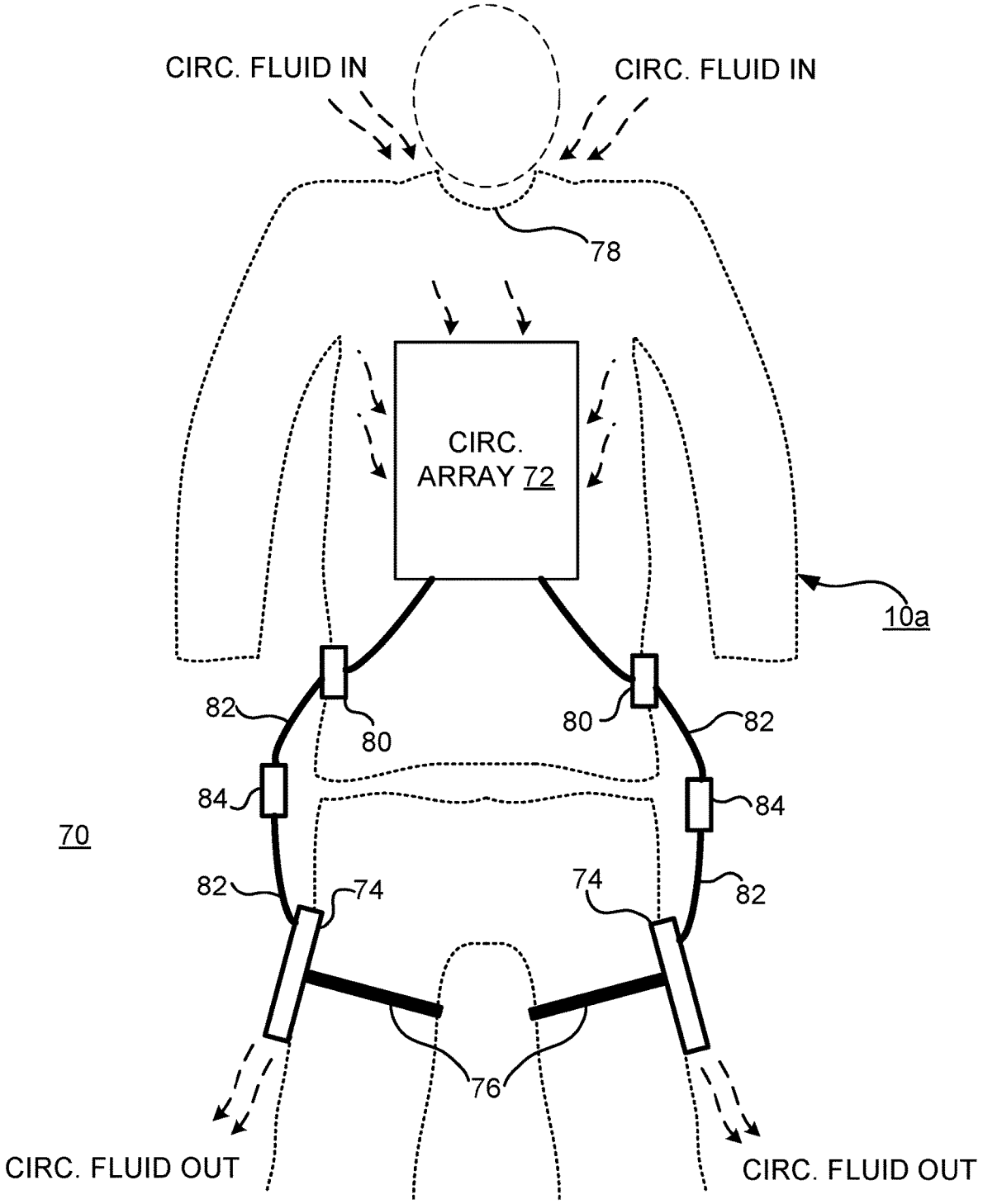
FIG. 8 is a front elevational and somewhat schematic depiction of a system including a garment worn about the torso and akin to that of FIG. 1, where the system pump-conditions the garment in accordance with various embodiments of the present innovation.

Turning now to FIG. 8, then, it is seen that in various embodiments of the present innovation, a system 70 is provided for pump-conditioning a garment 10*a* about the torso, which may be a short-sleeved garment (shown) or a long-sleeved garment akin to that of FIG. 1, where such garment 10*a* may for example be particularly suited for a surgeon or the like in a surgical environment or the like. In such circumstance, it is to be appreciated that the garment 10*a* may in fact be part of a set of hospital scrubs or the like worn by the surgeon, particularly about the torso thereof. Notably, the system 70 and garment 10*a* may have associated therewith any arrangement of panels 12 or other air circulation elements, which as is shown in FIG. 8 is collectively shown as a circulation array 72. Also notably, circulation array 72 need not necessarily include the panels 12 if other air circulation elements are deemed appropriate, and indeed if the garment 10*a* is amenable the circulation array 72 may be established solely by way of the dead spaces that can be expected to occur within a garment 10*a*, if appropriate.

In the system 70 of FIG. 8 et seq., and in various embodiments of the innovation, the pump(s) 26 that energize the system 70 are positioned below the garment 10*a* on the torso, and may be organized into one or more pump arrays 74, where each array 74 includes one or more of the pumps 26 in a unitary package or the like. Thus, each pump array 74 likely has a single inlet and a single outlet/exhaust, and may be operated as a unit to supply motive force which circulates cooling fluid through the circulation array 72 associated with the garment 10*a*. As may be expected, each pump array 74 may be powered and controlled in an appropriate manner by a power supply 36 and a controller 32 (FIG. 4), and multiple ones of the pump arrays 74 may be individually or centrally controlled by one or more of the controllers 32. As should be understood, each pump array 74 below the garment 10*a* may be secured to the individual wearing the garment 10*a* by way of straps 76 or the like placed about the legs of such individual. As envisioned, each pump array 74 would be secured by a strap 76 generally above the knee, mainly for comfort and ergonomics, although below the knee could be done if necessary and/or advisable. Note here that the power supply 36 and controller 32 could likewise be secured to the legs of the individual wearing the garment 10*a* by way of appropriate straps 76 (not shown). Such straps 76 may be most any appropriate straps without departing from the spirit and scope of the present innovation, such as for example hook-and-loop secured straps or elastic straps or the like. Such straps 76 are known or should be apparent to the relevant public and therefore need not be set forth herein in any detail other than that which is provided. As shown in FIG. 8, a pump array 74 is secured to each leg of the individual by respective straps 76, although greater or lesser numbers of pump arrays 74 in other arrangements may also be employed. It may be that the pump arrays 74 are arranged symmetrically and bilaterally on the individual so as to be balanced, both in terms of weight distribution and in terms of supplied motive force. Also, it may be that the pump arrays 74 are relatively flat and lightweight so as to be unobtrusive to the individual. Too, it may be that the pump arrays 74 are designed to comfortably fit within pockets or the like in pants or the like worn by the individual, in which case the straps 76 are likely not required. As should be understood, though, if placed within such a pocket, each pump array 74 should be appropriately arranged so as to avoid blocking circulating fluid from entering and/or leaving same.

In various embodiments of the present innovation, the pump arrays 74 are arranged and operated to exert a negative pressure (i.e., a vacuum) on the circulation array 72 associated with the garment 10*a*, so as to draw circulating fluid therefrom, and the circulation array 72 is likewise arranged with respect to the garment 10*a* so as to draw circulating fluid generally from the top of the garment 10*a* and in particular a head opening 78 defined by the garment 10*a*, generally about the neck of the individual wearing the garment. Empirically, it has been determined that a negative pressure on the order of 600 millibars or so may be generated by each pump array 74 so as to obtain acceptable results, which would include a flow rate of the circulating fluid through the head opening 78 on the order of about 0.5 to 20 liters per minute. Thus, and as shown in FIG. 8, the circulating fluid in response to the negative pressure of the pump array(s) 74 generally moves into the garment 10*a* at the head opening 78 thereof, then circulates through the circulation array 72 of the garment 10*a*, then moves out of the garment 10*a* toward the pump array(s) 74 of the system 70, and from the pump array(s) 74 the circulating fluid may then be generally directed down and away from the torso and head of the individual. As such, the moving circulating fluid draws heat and humidity from about the torso of the individual and specifically from within the garment 10*a*, and directs such heat and humidity away from such individual to cool and comfort same. Also, the moving circulating fluid in response to the negative pressure may tend to draw a cooling and comforting breeze about the head of the individual. As may be appreciated, particularly in the context where the individual is a surgeon in an operating room, the ambient air is typically supplied from above at a temperature of about 68 degrees or so and a relative humidity of about 50 percent or so, and thus such ambient air as drawn from about the head of the surgeon and above is highly suitable to be employed as the aforementioned moving circulating fluid within the garment 10*a* and system 70. As may also be appreciated, each pump array 74 may be constructed in any appropriate manner without departing from the spirit and scope of the present innovation so as to ensure that the pump array 74 does indeed direct the circulating fluid down and away from the torso and head of the individual. For example, the pump array 74 may have an exhaust port oriented downwardly, or may employ a length of tubing or conduit appropriately positioned to achieve such downward flow. Significantly, such downward flow is effectuated so as to be away from a surgical patient or the like of the surgeon or the like, thereby reducing the spreading of germs and other biologics from the garment 10 and the surgeon wearing same to the patient.

Figure 9A:
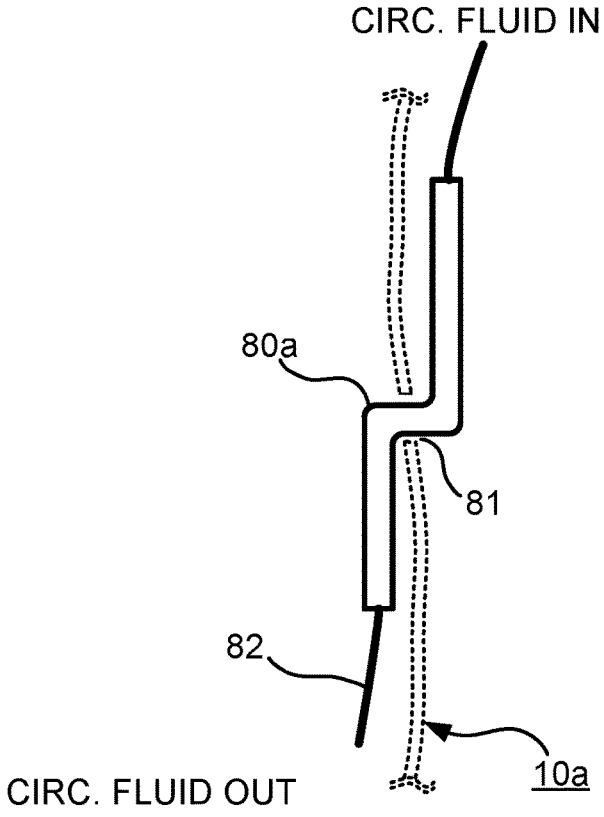
FIGS. 9A and 9B are partially cut-away perspective views of exiting ports affixed to the garment of FIG. 8 in accordance with various embodiments of the present innovation.
Figure 9B:
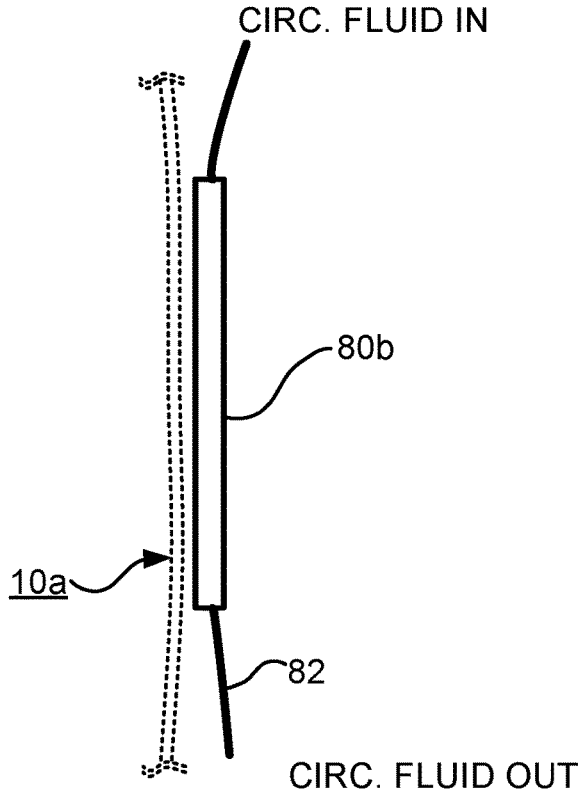

As also seen in FIG. 8, in various embodiments of the present innovation, the moving circulating fluid which is laden with heat and humidity from within the garment 10*a* exits same by way of one or more exiting ports 80 arranged about the lower areas of the garment 10*a*, where each exiting port has an inlet in communication with at least a portion of the circulation array 72 of the garment 10*a* and an outlet in communication with at least one of the pump arrays 74. As may be appreciated, the exiting ports 80 allow for relatively easy coupling of the pump arrays 74 to the circulation array 72 of the garment 10*a*. As shown in FIG. 8, one exiting port 80 is supplied for and associated with each pump array 74, although other arrangements including other numbers of exiting ports 80 may be employed without departing from the spirit and scope of the present innovation. As may be appreciated, each exiting port 80 may have any appropriate design without departing from the spirit and scope of the present innovation, and two such designs are illustrated in FIGS. 9A and 9B. As seen in FIG. 9A, the exiting port 80*a* is oriented to be substantially parallel to the general plane of the adjacent area of the garment 10*a*, and exhibits a slight jog so as to transition between an interior and an exterior side of the garment 10*a* through an aperture 81 defined therein. Thus, such exiting port 80*a* transitions the circulating fluid through the aperture 81 from the interior to the exterior of the garment 10*a*, and upon being appropriately coupled to the associated pump array 74 further transitions the circulating fluid to same. As may be appreciated, exiting port 80*a* has the advantage that the coupling to the associated pump array 74 may be performed at the exterior of the garment 10*a*, although such exiting port 80*a* does require that the garment 10*a* be supplied with the aperture 81. As seen in FIG. 9B, the exiting port 80*b* is wholly interior to the garment 10*a*. Thus, such exiting port upon being appropriately coupled to the associated pump array 74 to further transition the circulating fluid to same does not require the aperture 81 associated with exiting port 80*a*. However, coupling the exiting port 80*b* to the associated pump array 74 likely is performed at the interior of the garment 10*a*, which may be more cumbersome and therefore difficult. In either the exiting port 80*a* or 80*b*, such port or 80*b* is appropriately coupled to the circulation array 72 within the garment 10*a* by an appropriate mechanism which should be known or apparent to the relevant public and therefore need not be set forth herein in any detail, and such port 80*a* or is appropriately secured to the garment 10*a* by an appropriate mechanism which should be known or apparent to the relevant public and therefore need not be set forth herein in any detail.

In various embodiment of the present innovation, each exiting port 80 is appropriately coupled to the associated pump array 74 by way of a flexible conduit 82 such as a flexible plastic tube or the like. As should be appreciated, such flexible conduit 82 should be supplied and arranged so as to not appreciably restrict the range of motion of the individual wearing the garment 10*a*. Thus, the flexible conduit 82 should be long enough to allow free movement of the individual, but not so long that flexible conduit 82 flies about, or even trips the individual. Such flexible conduit 82 should also be easily coupled to the exiting port 80 and also the pump array 74 without undue effort, by way of an appropriate coupling mechanism. Such coupling mechanism is known or should be apparent to the relevant public and therefore need not be set forth herein in any detail other than that which is provided. Thus, such coupling mechanism may be any appropriate coupling mechanism without departing from the spirit and scope of the present innovation.

Figure 10A:
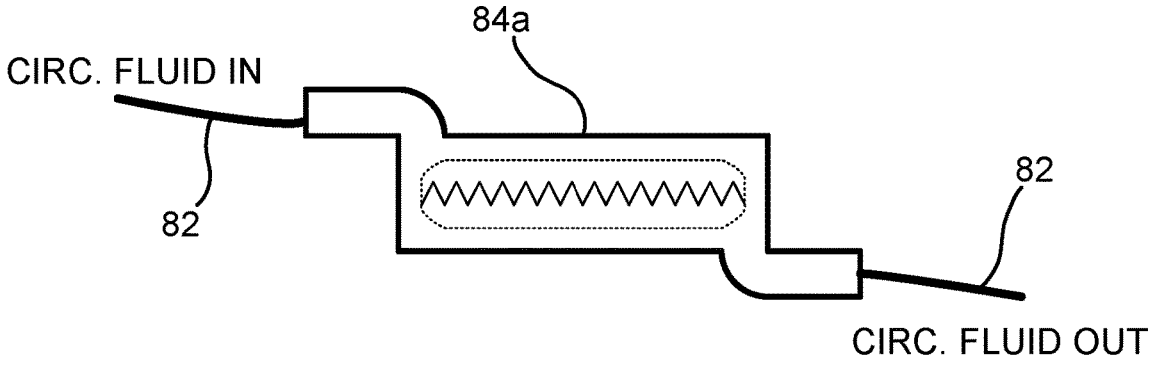
FIGS. 10A and 10B are partially cut-away perspective views of filters employed in the system of FIG. 8 in accordance with various embodiments of the present innovation.
Figure 10B:
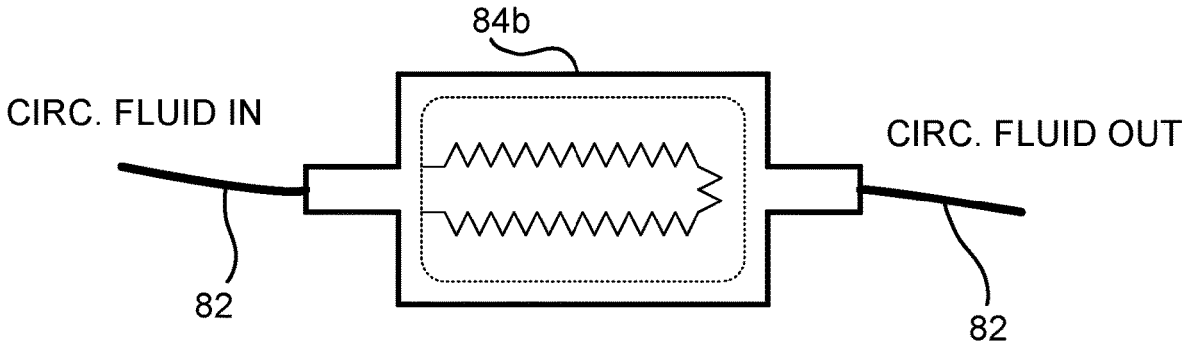

In various embodiments of the present innovation, a replaceable filter 84 is interposed between each exiting port 80 and the corresponding pump array 74 of the system 70, as is seen in FIG. 8. As shown, each filter 84 may be coupled to each of the exiting port 80 and the corresponding pump array 74 by way of corresponding sections of flexible conduit 82. Alternately, the filter 84 may be coupled directly to one of the exiting port 80 and the corresponding pump array 74 so as to use only one section of flexible conduit 82 to couple to the other of the exiting port 80 and the corresponding pump array 74. As may be appreciated, the filter 84 is intended to restrict excess dust and other particulates from reaching the corresponding pump array 74, thereby extending the life and efficient operation of same. Also, the filter 84 is intended to collect germs and other biologic matter from reaching the corresponding pump array 74 and being distributed externally therefrom and about the individual, thereby helping to prevent possible infections in patients being operated on by surgeons, for example. In addition, the filter 84 acts to prevent any liquid droplets originating about the circulation array 72 from entering any of the pumps 26 of the corresponding pump array 74, which as may be appreciated can harm same. As envisioned, the filter 84 may be replaced daily, or perhaps more often as is necessary based on circumstances and issues of good hygiene and sterility. In various embodiments, and as shown in FIGS. 10A and 10B, the filter 84*a* may have a relatively flat and unobtrusive design (FIG. 10A), or the filter 84*b* may have a relatively cylindrical but more obtrusive design (FIG. 10B). As may be appreciated, the filter 84*a* that is relatively flat, perhaps on the order of 0.5 to 1 centimeters in depth, may have a generally circular cross-section with a diameter on the order of 3 to 8 centimeters and therefore relatively inobtrusive to the individual wearing the garment 10*a* of the system 70, but perhaps relatively more expensive. In contrast, the filter 84*b* is more prominent, perhaps on the order of 2 centimeters in diameter, and therefore less comfortable to such individual, but is likely more easily integrated with the associated flexible conduit 82, should that be desirable. In either instance, the filter 84*a* or 84*b* can be pleated or flat and may be expected to be inexpensive, hydrophobic, and have a pore size on the order of 0.1 to 6 micrometers, and within reason can flex.

Figure 11:
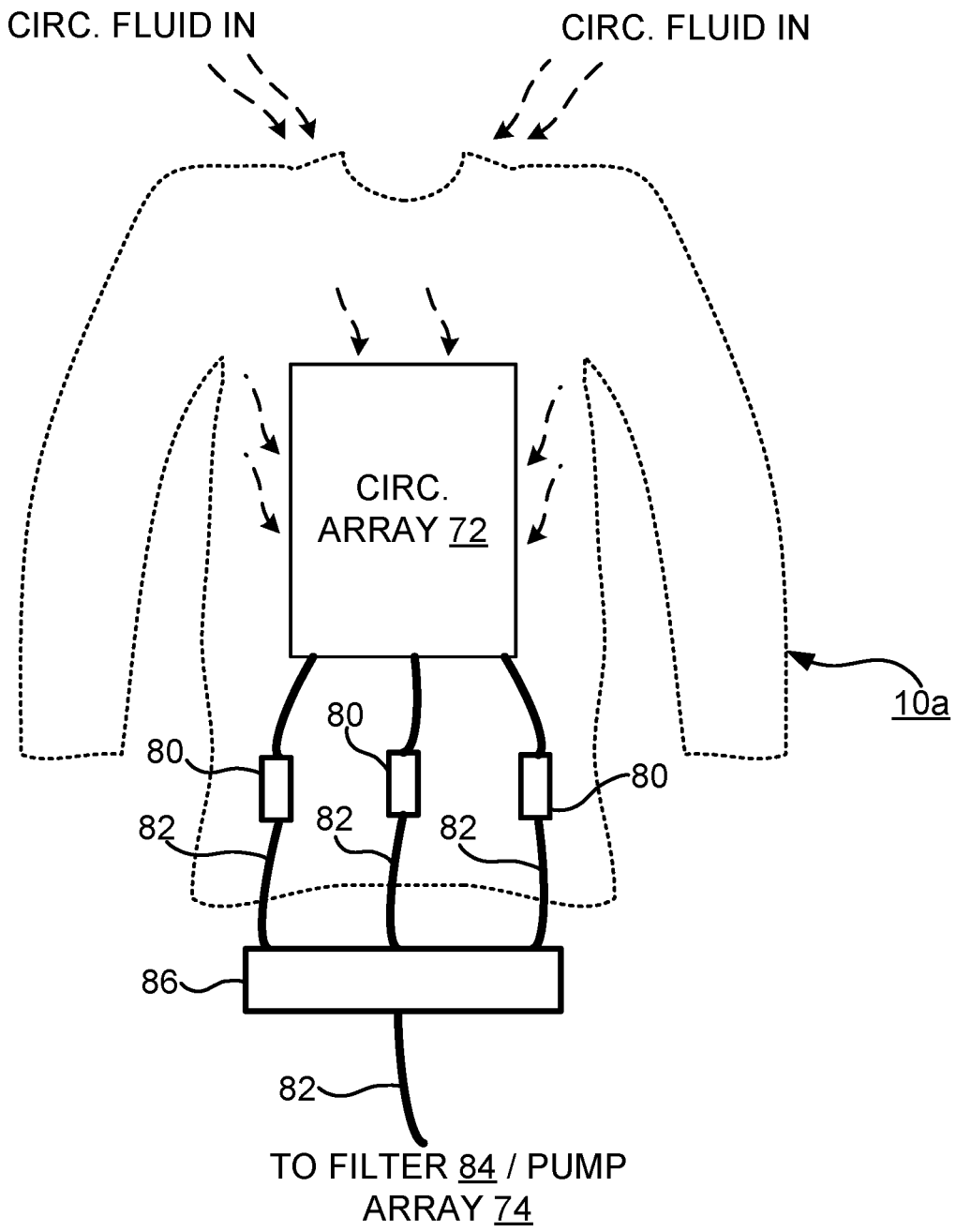
FIG. 11 is a front elevational and somewhat schematic depiction of a system akin to that of FIG. 8, where multiple exiting ports of FIGS. 9A and 9B are supplied and associated with each pump array of FIG. 8 in accordance with various embodiments of the present innovation.

As was alluded to above in connection with FIG. 8, although one exiting port 80 may be supplied for and associated with each pump array 74, it may instead be the case that multiple exiting ports 80 may be supplied for and associated with each pump array 74, such as for example in the manner shown in FIG. 11. In particular, in FIG. 11 it is seen that three exiting ports 80 are supplied for and associated with a pump array 74, and that a juncture manifold 86 and appropriate conduits 82 are provided to effectuate such arrangement. Such juncture manifold 86 may be any appropriate manifold arranged in any appropriate manner to couple any appropriate number of exiting ports 80 without departing from the spirit and scope of the present innovation. Thus, multiple exiting ports 80 may be channeled to one pump array 74 if so desired, perhaps in an effort to place fewer or no panels 12 within the circulation array 72 of the garment 10*a*. Note here that while multiple exiting ports 80 may reduce the number of panels 12, such multiple exiting ports 80 increase the time and effort required to couple each corresponding conduit 82 to the garment 10*a*, and in general increases the complexity of the garment 10*a*, both in terms of design and manufacture. As shown in FIG. 11, a single filter 84 is interposed between an outlet of the juncture manifold 86 and the corresponding pump array 74, although multiple filters 84 may instead be employed (not shown), each of such multiple filters 84 perhaps being interposed between a corresponding inlet of the juncture manifold 86 and a corresponding exiting port 80.

As set forth above, each pump array 74 below the garment 10*a* may be secured to the individual wearing the garment 10*a* by way of straps 76 or the like placed about the legs of such individual, as is seen in FIG. 8, which is particularly useful if for example the individual is a surgeon or the like wearing a long garment 10*a*, or is wearing a long apron over the garment 10*a*, such as for example a lead apron. As such, each pump array 74 is below the long garment 10*a*/long apron and is therefore relatively open and accessible. Alternately, if such long garment 10*a*/long apron is not a concern, it may be that each pump array 74 is still open and accessible if secured just below the garment 10*a*, perhaps about the waist of such individual, by way of appropriately sized straps 76 or belting or the like, or even by way of being clipped to a belt about the waist of the individual or the like (not shown). In such case, each pump array 74 at the waist of the individual should be appropriately designed and/or configured to ensure that the aforementioned downward flow therefrom is still away from a surgical patient or the like if the individual is a surgeon or the like.

Significantly, most every element of the system 70 of FIG. 8 et seq. may be designed to be disposable. As should be appreciated, then, such elements need not be sterilized or the like between patients of a surgeon or the like, or can be used for one day as appropriate, for example. Thus, a surgeon performing multiple surgeries in a day may wear a single torso garment 10*a* for that day and dispose of same at the end of the day, and replace the conduits 82 and filters 84 between each surgery, if he or she so chooses or if it is deemed good practice. Note here though that each pump array 74 as presently envisioned is likely more expensive and thus might not be considered as disposable unless warranted by circumstances.

Also significantly, the system 70 of the present innovation can be arranged with regard to the garment 10*a* so that upon appropriate customization specific portions of the torso of the individual can be ventilated. More generally, all manner of arrangements of the circulation array 72 within the garment 10*a* and the corresponding exiting ports 80, conduits 82, filters 84, manifolds 86, etc. may be employed without departing from the spirit and scope of the present innovation. As should be appreciated, rationales for such arrangements and details for effectuating same are known or should be apparent to the relevant public and therefore need not be set forth herein with any detail beyond that which is already provided. Notably, with any such arrangement, precision ventilation may be provided within the garment 10*a* to promote heat and humidity comfort, where different portions of the torso or other parts of the body can be ventilated at different rates. Thus, it may be that a person wearing a backpack may only need ventilation along the back of the torso, while a surgeon wearing a lead apron may need more ventilation along the front of the torso, and in either case as well as many other cases, the garment 10*a* can be appropriately designed to have a system 70 that accommodates the particular need.

CONCLUSION

Any programming and protocols believed necessary to effectuate the processes performed by the controller 32 in particular for the pump-conditioned garment 10, 10*a* of the present innovation should be relatively straight-forward and should be apparent to the relevant programming and protocol-setting public. Accordingly, such programming and protocols are not attached hereto. Any particular programming and protocols, then, may be employed to effectuate the various embodiments of the present innovation without departing from the spirit and scope thereof.

In the present innovation, a system 70 is provided to pump-condition a garment 10*a* so as to actively and adaptably vent the garment 10*a*, particularly but not exclusively in the context of a surgeon or the like wearing the garment 10*a*. The apparatus draws circulating fluid through the garment 10*a* from the head down in an effort to establish an environment within the garment 10*a* that is more comfortable to an individual/surgeon wearing the garment 10*a*, and also in an effort to reduce spreading germs and other biologics from the garment 10*a* and the individual/surgeon to a patient or the like. The system 70 is adaptable and customizable and many if not all components thereof are disposable to reduce spreading the aforesaid germs and other biologics between patients or the like.

It should be appreciated that changes could be made to the embodiments described above without departing from the innovative concepts thereof. For example, the system 70 though primarily disclosed in terms of a surgeon operating on patients can also be employed in any other appropriate context. Likewise, the garment 10*a* though primarily set forth as a wearable garment can also be any covering or protective device meant for an individual where the individual may wish to control the environment interior thereto. Also, although the system 70 and the garment 10*a*, pump 26, pump array 74, etc. thereof are set forth primarily in terms of operation with air as the circulating fluid, such system 70 may instead operate with any other fluid, be it a gas or a liquid, as may be deemed necessary and/or desirable. Finally, although suggestions for placement of individual elements may be provided herein, such elements may be placed in any appropriate manner with respect to each other and with respect to the system 70 and the garment 10*a*, again as may be deemed necessary and/or appropriate. For example, in this regard, although the circulation array 72 has been discussed primarily as panels 12 or dead spaces, such circulation array 72 can comprise a combination of panels 12 and dead spaces, as may be deemed necessary and/or desirable. Likewise, although a single juncture manifold 86 is shown and disclosed in connection with FIG. 11, multiple juncture manifolds 86 and arrangements thereof may alternately be employed. It should be understood, therefore, that this innovation is not limited to the particular embodiments disclosed, but it is intended to cover modifications within the spirit and scope of the present innovation as defined by the appended claims.

The invention claimed is:

1. A system pump-conditioning a garment worn about a torso of an individual, the system comprising:

a circulation array circulating a fluid within an interior space between the garment and the torso of the individual in an effort to condition the individual; and one or more pumps organized into one or more pump arrays, each pump array including the pumps thereof in a unitary package and also including an inlet and an outlet, each pump array being operated as a unit to provide motive force to move the circulating fluid through the circulation array, each pump array being operated to exert a negative pressure on the circulation array within the garment so as to draw circulating fluid therefrom, the circulation array being arranged with respect to the garment to draw circulating fluid generally from a head opening at a top portion of the garment, the circulating fluid in response to the negative pressure of each pump array generally moving into the interior space of the garment at the head opening thereof, then through the circulation array, then out of the garment toward the inlet of each pump array, each pump array receiving the circulating fluid at the inlet thereof and exhausting same at the outlet thereof down and away from the torso of the individual, whereby the moving circulating fluid draws heat and humidity from about the torso of the individual within the garment, and directs such heat and humidity away from such individual to cool and comfort same, and whereby the moving circulating fluid draws a cooling and comforting breeze about a head of the individual.

2. The system of claim 1 for pump-conditioning a surgical scrub garment worn by a surgeon performing a procedure on a patient, the system exhausting the circulating fluid down and away from the patient so as to avoid spreading germs and other biologic materials within the circulating fluid from the surgeon toward the patient.

3. The system of claim 1 wherein the circulation array comprises at least one vent panel mounted to the garment and in communication with the interior space.

4. The system of claim 1 wherein the circulation array comprises dead space defined within the interior space.

5. The system of claim 1 wherein each pump array is for being positioned on the individual below the garment, the system further comprising a strap for each pump array to secure same to the individual about a leg thereof.

6. The system of claim 1 comprising a pair of pump arrays, each pump array for being positioned on the individual below the garment, the system further comprising a strap for each pump array to secure same to the individual about a leg thereof, one pump array on each leg of the individual, the pump array for being arranged symmetrically and bilaterally on the individual so as to be balanced in terms of weight distribution and in terms of supplied motive force.

7. The system of claim 1 wherein the outlet of each pump array is an exhaust port oriented downwardly so as to direct exhausted circulating fluid down and away from the torso of the individual.

8. The system of claim 1 wherein the outlet of each pump array exhausts circulating fluid through an attached exhaust conduit positioned to direct exhausted circulating fluid down and away from the torso of the individual.

9. The system of claim 1 further comprising at least one exiting port arranged about a lower area of the garment, each exiting port having an inlet in communication with at least a portion of the circulation array and an outlet in communication with one of the one or more pump arrays, each exiting port coupling the one of the one or more pump arrays to the circulation array.

10. The system of claim 1 further comprising at least one exiting port arranged about a lower area of the garment, each exiting port having an inlet in communication with at least a portion of the circulation array and an outlet in communication with one of the one or more pump arrays, each exiting port coupling one of the one or more pump arrays to the circulation array, each exiting port being oriented to be substantially parallel to a general plane of an adjacent area of the garment, and exhibiting a slight jog so as to transition between an interior and an exterior side of the garment through an aperture defined therein, thereby transitioning the circulating fluid through the aperture from the interior to the exterior of the garment and then onward to the one of the one or more pump arrays, whereby the coupling to the one of the one or more pump arrays is performed at the exterior of the garment.

11. The system of claim 1 further comprising at least one exiting port arranged about a lower area of the garment, each exiting port having an inlet in communication with at least a portion of the circulation array and an outlet in communication with one of the one or more pump arrays, each exiting port coupling one of the one or more pump arrays to the circulation array, each exiting port being wholly interior to the garment.

12. The system of claim 1 further comprising a filter interposed between each pump array and the circulation array so that the circulating fluid from the circulation array to the pump array passes through such filter, each filter restricting excess dust and other particulates from reaching the pump array, and also collecting germs and other biologic matter from reaching the pump array and being exhausted therefrom, the filter being replaced as necessary based on circumstances and issues of good hygiene and sterility.

13. The system of claim 1 further comprising a filter interposed between each pump array and the circulation array so that the circulating fluid from the circulation array to the pump array passes through such filter, each filter restricting excess dust and other particulates from reaching the pump array, and also collecting germs and other biologic matter from reaching the pump array and being exhausted therefrom, the filter being replaced as necessary based on circumstances and issues of good hygiene and sterility, the filter having a flat and unobtrusive design so as to be more comfortable as experienced by the individual wearing the garment.

14. The system of claim 1 further comprising a filter interposed between each pump array and the circulation array so that the circulating fluid from the circulation array to the pump array passes through such filter, each filter restricting excess dust and other particulates from reaching the pump array, and also collecting germs and other biologic matter from reaching the pump array and being exhausted therefrom, the filter being replaced as necessary based on circumstances and issues of good hygiene and sterility, the filter having a cylindrical design.

15. The system of claim 1 further comprising a filter interposed between each pump array and the circulation array so that the circulating fluid from the circulation array to the pump array passes through such filter, each filter restricting excess dust and other particulates from reaching the pump array, and also collecting germs and other biologic matter from reaching the pump array and being exhausted therefrom, the filter being replaced as necessary based on circumstances and issues of good hygiene and sterility, the filter having a pore size on the order of 0.1 to 6 micrometers.

16. The system of claim 1 further comprising a filter interposed between each pump array and the circulation array so that the circulating fluid from the circulation array to the pump array passes through such filter, each filter restricting excess dust and other particulates from reaching the pump array, and also collecting germs and other biologic matter from reaching the pump array and being exhausted therefrom, the filter being replaced as necessary based on circumstances and issues of good hygiene and sterility, the filter being coupled to the pump array and the circulation array by way of flexible conduit.

17. The system of claim 1 further comprising a filter interposed between each pump array and the circulation array so that the circulating fluid from the circulation array to the pump array passes through such filter, each filter restricting excess dust and other particulates from reaching the pump array, and also collecting germs and other biologic matter from reaching the pump array and being exhausted therefrom, the filter being replaced as necessary based on circumstances and issues of good hygiene and sterility, the filter being mounted directly to the pump array.

18. The system of claim 1 further comprising a plurality of exiting ports arranged about a lower area of the garment, each exiting port having an inlet in communication with at least a portion of the circulation array and an outlet in communication with one of the one or more pump arrays, the plurality of exiting ports coupling one of the one or more pump arrays to the circulation array, the system further comprising a juncture manifold interposed between the plurality of exiting ports and the one of the one or more pump arrays, the one of the one or more pump arrays receiving the circulating fluid at the inlet thereof from the corresponding plurality of exiting ports by way of the juncture manifold and exhausting same at the outlet thereof down and away from the torso of the individual.

19. A system pump-conditioning a garment worn about a torso of an individual, the system comprising:

a circulation array circulating a fluid within an interior space between the garment and the torso of the individual in an effort to condition the individual; and one or more pumps organized into one or more pump arrays, each pump array including the pumps thereof in a unitary package and also including an inlet and an outlet, each pump array being operated as a unit to provide motive force to move the circulating fluid through the circulation array, each pump array being operated to exert a negative pressure on the circulation array within the garment so as to draw circulating fluid therefrom, the circulation array being arranged with respect to the garment to draw circulating fluid generally from a head opening at a top portion of the garment, the circulating fluid in response to the negative pressure of each pump array generally moving into the interior space of the garment at the head opening thereof, then through the circulation array, then out of the garment toward the inlet of each pump array, each pump array receiving the circulating fluid at the inlet thereof and exhausting same at the outlet thereof down and away from the torso of the individual, whereby the moving circulating fluid draws heat and humidity from about the torso of the individual within the garment, and directs such heat and humidity away from such individual to cool and comfort same, and whereby the moving circulating fluid draws a cooling and comforting breeze about a head of the individual, the system further comprising at least one exiting port arranged about a lower area of the garment, each exiting port having an inlet in communication with at least a portion of the circulation array and an outlet in communication with one of the one or more pump arrays, each exiting port coupling the one of the one or more pump arrays to the circulation array, the system further comprising a filter interposed between each pump array and the circulation array so that the circulating fluid from the circulation array to the pump array passes through such filter, each filter restricting excess dust and other particulates from reaching the pump array, and also collecting germs and other biologic matter from reaching the pump array and being exhausted therefrom, the filter being replaced as necessary based on circumstances and issues of good hygiene and sterility, the system for pump-conditioning a surgical scrub garment worn by a surgeon performing a procedure on a patient, the system exhausting the circulating fluid down and away from the patient so as to avoid spreading germs and other biologic materials within the circulating fluid from the surgeon toward the patient, the circulation array, each exiting port, and each filter being disposable, whereby same need not be sterilized between patients of the surgeon and can be disposed along with the garment.

20. The system of claim 19 wherein the outlet of each pump array is an exhaust port oriented downwardly so as to direct exhausted circulating fluid down and away from the torso of the individual.

* * * * *